US006760001B2

(12) United States Patent
Kanda et al.

(10) Patent No.: US 6,760,001 B2
(45) Date of Patent: Jul. 6, 2004

(54) METHOD OF ADJUSTING CHARACTERISTICS OF ELECTRON SOURCE, METHOD OF MANUFACTURING ELECTRON EMISSION DEVICE

(75) Inventors: Makoto Kanda, Tokyo (JP); Takahiro Oguchi, Kanagawa (JP); Akihiko Yamano, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 10/067,796

(22) Filed: Feb. 8, 2002

(65) Prior Publication Data

US 2002/0122018 A1 Sep. 5, 2002

(30) Foreign Application Priority Data

| | | |
|---|---|---|
| Feb. 9, 2001 | (JP) | 2001-034261 |
| Aug. 8, 2001 | (JP) | 2001-240580 |
| Feb. 6, 2002 | (JP) | 2002-029756 |

(51) Int. Cl.[7] ..... G09G 3/22
(52) U.S. Cl. ..... 345/74.1; 345/75.2
(58) Field of Search ..... 345/74.1, 75.2, 345/74, 75, 76, 77, 78, 212; 313/309, 310, 495, 496; 315/169.3, 167

(56) References Cited

U.S. PATENT DOCUMENTS

| | | | | |
|---|---|---|---|---|
| 4,849,674 A | | 7/1989 | Cherry et al. | 313/509 |
| 5,386,172 A | * | 1/1995 | Komatsu | 313/309 |
| 5,659,328 A | * | 8/1997 | Todokoro et al. | 345/74.1 |
| 6,236,167 B1 | * | 5/2001 | Yamaguchi et al. | 315/169.2 |
| 6,621,475 B1 | * | 9/2003 | Yamaguchi et al. | 345/74.1 |

FOREIGN PATENT DOCUMENTS

| | | |
|---|---|---|
| EP | 0 803 892 | 10/1997 |
| JP | 63-289794 | 11/1988 |
| JP | 10-228867 | 8/1998 |

* cited by examiner

*Primary Examiner*—Vijay Shankar
*Assistant Examiner*—Nitin Patel
(74) *Attorney, Agent, or Firm*—Fitzpatrick, Cella, Harper & Scinto

(57) ABSTRACT

The present application discloses a characteristic adjusting method of executing a step of changing the characteristics of display devices in an image display apparatus. In particular, the present invention discloses a configuration in which target values for changes in characteristics are obtained by reducing the high-frequency components of the spatial distribution of the characteristics of the display devices.

40 Claims, 21 Drawing Sheets

FIG. 23

$$\begin{pmatrix} -7 & -2 & 1 & 2 & 1 & -2 & 7 \\ -2 & 3 & 6 & 7 & 6 & 3 & -2 \\ 1 & 6 & 9 & 10 & 9 & 6 & 1 \\ 2 & 7 & 10 & 11 & 10 & 7 & 2 \\ 1 & 6 & 9 & 10 & 9 & 6 & 1 \\ -2 & 3 & 6 & 7 & 6 & 3 & -2 \\ -7 & -2 & 1 & 2 & 1 & -2 & 7 \end{pmatrix}$$

METHOD OF ADJUSTING CHARACTERISTICS OF ELECTRON SOURCE, METHOD OF MANUFACTURING ELECTRON EMISSION DEVICE

BACKGROUND OF THE INVENTION

1. Field of the Invention

The present invention relates to an electron source and an image display device. In particular, the present invention relates to a method and apparatus for adjusting a characteristic of an electron source or image display device and a method and apparatus for manufacturing the electron source or image display device.

2. Related Background Art

Electron sources each comprising a plurality of electron emitting devices have been known. Image display apparatuses each comprising a plurality of display devices have also been known. Image display apparatuses have been known which use as display devices electron emitting devices (combined with fluorescent materials that emit light when irradiated with electrons) or electroluminescence devices.

Two types of electron emitting devices, that is, hot-cathode devices and cold-cathode devices have been known. The known cold-cathode devices include, for example, field emitting devices, metal/insulated layer/metal type emitting devices, and surface conduction type emitting devices.

The cold-cathode devices, the surface conduction type electron-emitting devices (hereinafter simply referred to as the "devices") utilizes the phenomenon in which electrons are emitted by causing current to flow through a small-area thin film and parallel with its surface, the film being formed on a substrate and composed of $SnO^2$, Au, $In^2O^3/SnO^2$, carbon, or the like.

FIG. 15 shows an example of a typical device configuration. In this figure, reference numeral 3001 denotes a substrate, and reference numeral 3004 denotes a conductive thin film composed of a metal oxide and formed by sputtering. The conductive thin film 3004 is formed as an H-shaped plane as shown in the figure. The conductive thin film 3004 is subjected to a process called "forming" to form an electron emitting section 3005. The interval L in the figure is set between 0.5 and 1 mm, and the interval W therein is set at 0.1 mm. For the convenience of illustration, the electron emitting section 3005 is shown at the center of the conductive thin film 3004 to have a rectangular shape. However, this is schematic and does not faithfully represent the position or shape of the actual electron emitting section.

As described previously, to form an electron emitting section in a surface conduction type emitting device, current is allowed to flow through a conductive thin film to locally destroy, deform, or modify it to form a crack therein (forming process). Subsequently, an activation process can be executed to significantly improve an electron emitting characteristic.

That is, the activation process allows current to flow through the electron emitting section under appropriate conditions, the electron emitting section having been formed by a forming process, so that carbons or carbon compounds deposit in the vicinity of the electron emitting section. For example, in a vacuum atmosphere in which organisms under an appropriate pressure are present and which has a total pressure of $10^{-2}$ to $10^{-3}$ [Pa], by periodically applying pulses having a predetermined voltage, monocrystal graphite, polycrystal graphite, amorphous carbon, or a mixture thereof is deposited in the vicinity of the electron emitting section so as to have a thickness of about 500 Angstrom or less. However, these conditions are only an example and may be properly varied depending on the material or shape of the surface conduction type emitting device.

Such a process enables emitted current to be increased by a factor of 100 or more with the same applied voltage compared to a value measured immediately after forming. Accordingly, even when a multi-electron-source is manufactured which utilizes a large number of surface conduction type emitting devices such as those described above, each device is preferably subjected to the activation process. (After the activation process has been completed, the partial pressure on the organisms in the vacuum atmosphere is desirably reduced. This is called a "stabilizing process".)

FIG. 16 shows a typical example of the emitted current Ie vs. device applied voltage Vf characteristic and device current If vs. device applied voltage Vf of a surface conduction type electron-emitting device.

The emitted current Ie is significantly smaller than the device current If, and it is thus difficult to illustrate it using the same scale. Further, these characteristics may be varied by varying design parameters such as the size and shape of the devices. Accordingly, the two graphs in the figure are shown in the respective arbitrary units.

The surface conduction type electron-emitting devices have the following three characteristics in connection with the emitted current Ie.

When a voltage equal to or larger than certain magnitude (this will be hereinafter referred to as a "threshold voltage Vth") is applied to the devices, they rapidly emit the emitted current Ie. On the other hand, with a voltage lower than the threshold voltage Vth, substantially no emitted current Ie is detected. That is, these are nonlinear devices having the definite threshold voltage Vth in connection with the emitted current Ie.

Since the emitted current Ie varies depending on the voltage Vf applied to the devices, the magnitude of the emitted current Ie can be controlled using the voltage Vf.

The current Ie emitted from the devices responds to the voltage Vf applied to the devices, at high speed, so that the amount of charges in electrons emitted from the devices can be controlled on the basis of the period of time for which the voltage Vf is applied.

In addition to the adjustment based on activation, the adjustment of the characteristics of the surface conduction type electron-emitting devices can be achieved by applying a voltage equal to or higher than a certain voltage (threshold voltage Vth) to the devices, that is, applying a characteristic shift voltage that adjusts the characteristics of the devices, as described in Japanese Patent Application Laid-Open No. 10-228867.

Further, since the surface conduction type electron-emitting devices have a simple structure and can be easily manufactured, they are advantageous in that a large number of devices can be formed over a large area. Thus, image forming apparatuses such as image display and recording apparatuses as well as electron beam sources have been researched to which the surface conduction type electron-emitting devices are applied.

The inventors have tested various surface conduction type electron-emitting devices that are composed of different materials, have different structures, and are manufactured using different methods. The inventors have also studied multi-electron-sources (simply referred to as "electron sources") having a large number of surface conduction type electron-emitting devices arranged therein as well as image display apparatuses to which these electron sources have been applied.

For example, the inventors have tested an electron source based on the electrical wiring method shown in FIG. 17. In the figure, reference numeral 4001 denotes a schematically illustrated surface conduction type electron-emitting device, 4002 is a row-wise wire, and 4003 is a column-wise wire. In FIG. 17, reference numerals 4004 and 4005 denote wiring resistances.

The above described wiring method is called "simple matrix wiring". For the convenience of illustration, a 6×6 matrix is shown, but the scale of the matrix is not limited to this example.

In an electron source comprising devices connected together using the simple matrix wiring method, an appropriate electric signal is applied to the row-wise wires 4002 and the column-wise wires 4003. At the same time, a high voltage is applied to an anode (not shown).

For example, to drive arbitrary devices in the matrix, a selected voltage Vs is applied to the terminals of the row-wise wires 4002 for the selected rows, while, at the same time, a non-selected voltage Vns is applied to the terminals of the row-wise wires 4002 for the non-selected rows. Synchronously, modulation voltages Ve1 to Ve6 are applied to the terminals of the column-wise wires 4003 to output emitted current. With this method, the voltages Ve1−Vs to Ve6 are applied to the selected devices, while the voltages Ve1−Vns to Ve6 are applied to the non-selected devices. Emitted current of a desired intensity is output only from the selected devices by setting the voltages Ve1 to Ve6, Vs, and Vns at appropriate magnitudes so that a voltage equal to or higher than the threshold voltage Vth is applied to the selected devices, whereas a voltage lower than the threshold voltage Vth is applied to the non-selected devices.

Accordingly, the multi-electron-source comprising surface conduction type electron-emitting devices connected together using the simple matrix wiring method may be used for various applications. For example, the multi-electron-source is preferably used for an image display apparatus by properly applying an electric signal to this source, for example, in accordance with image information.

Further, in addition to the surface conduction type electron-emitting devices, electron emitting devices called "spindt type electron emitting devices" are known which each comprise projecting emitters (emitter cones) and gate electrodes located in proximity thereto. Also in the spindt type electron emitting device, after an emitter and a gate has been constructed, the electron emitting characteristic of the device can be adjusted by applying a voltage between the emitter and the gate. It is also known that the characteristic of an electroluminescence device varies depending on a voltage or heat applied to the device.

SUMMARY OF THE INVENTION

For display devices such as electron emitting devices, a characteristic (for example, in the case of electron emitting devices, the electron emission characteristic) of the individual devices may vary slightly. If these devices are used to produce a display apparatus, then this variation in characteristic results in a variation in luminance. Japanese Patent Application Laid-Open No. 10-228867 and other publications use a step of reducing this variation.

The causes of the different electron emission characteristics of the electron emitting devices of an electron source include, for example, a variation in the components of a material used for the electron emitting section, an error in the size or shape of each member of the device, non-uniform conduction conditions for a conductive forming process, and non-uniform conduction conditions or atmospheric gases for an conductive activation process. However, elimination of all these causes requires a very advanced manufacture facility and very rigorous process management, and enormous costs are required to meet these requirements.

This is also applicable to the use of electron emitting devices other than the surface conduction type electron-emitting devices or display devices other than the electron emitting devices.

The inventors have made wholehearted efforts to find that in particular non-uniform display is significantly perceived if this variation has a high-frequency component. Thus, the inventors have concluded that a target value for a change in characteristics should be set so as to reduce, in particular, high-frequency components of the spatial distribution of a variation in characteristics.

An aspect of the invention according to present application is constructed as follows:

That is, the present invention provides a method of adjusting a characteristic of an electron source having a plurality of electron emitting devices arranged on a substrate, the method being characterized by comprising:

a characteristic changing step of changing electron emission characteristics of the electron emitting devices, and in that in the characteristic changing step, target values indicative of targets for changes in electron emission characteristic are such that a spatial distribution of the target values has spatial frequencies obtained by removing predetermined high-frequency components from spatial frequencies of a spatial distribution of the electron emission characteristics of the plurality of electron emitting devices obtained before the characteristic changing step or reducing predetermined high-frequency components of the spatial distribution, and in the characteristic changing step, the electron emission characteristics are changed so as to approach the respective target values.

The spatial distribution of the electron emission characteristics of the electron emitting devices is obtained by plotting the electron emission characteristics of the plurality of electron emitting devices in association with the positions of the electron emitting devices. In this case, when the plurality of electron emitting devices are linearly arranged, a line extending along the direction in which the devices are arranged is defined as an X axis, and a spatial distribution is obtained by showing data indicative of the electron emission characteristics of the devices in the direction of a Z axis. When the electron emitting devices are two-dimensionally arranged, the plane on which the devices are arranged is defined as an XY plane, and a spatial distribution is obtained by showing the electron emission characteristics in the direction of the Z axis depending on the positions of the devices. This is also applicable to the space distribution of the target values, and the spatial distribution is obtained by plotting the target values for the plurality of electron emitting devices in association with the positions of the electron emitting devices.

To set the spatial distribution of the target values to contain the spatial frequencies obtained by removing the predetermined high-frequency components from the spatial frequencies of the spatial distribution of the electron emission characteristics of the plurality of electron emitting devices obtained before the characteristic changing step or reducing the predetermined high-frequency components of the spatial distribution, the following filtering step is preferably executed: the spatial distribution of the electron emission characteristics of the plurality of electron emitting devices obtained before the characteristic changing step is converted into spatial frequencies, and subsequently the predetermined high-frequency components are removed from the spatial frequencies obtained or the ratio of the predetermined high-frequency components to the spatial frequencies is reduced, and then the resulting spatial frequencies are converted into a spatial distribution for target values. The conditions in the present invention are met if the spatial distribution of target values obtained by another method, for example, polynominal approximation, described later, or target values obtained by using another filtering method for-instance a convolution operation to smooth a spatial distribution without converting it into spatial frequencies has resultingly spatial frequencies obtained by removing predetermined high-frequency components from the spatial frequencies of the spatial distribution of the electron emission characteristics of the plurality of electron emitting devices obtained before the characteristic changing step or reducing predetermined high-frequency components of the spatial distribution.

In the context of the specification, the predetermined high frequency components means "components" which appear as disadvantageous variations for electron emission characteristics or display characteristics, for instance a visually harmful variation in a displayed image, if the variation has some amplitude (magnitude). What is meant by these predetermined high frequency components depend area size in arrangement of electron emission devices, space between electron emission devices in the electron source or display apparatus and etc. One way of determining the predetermined high frequency components is based on experiments. A plurality of electron sources and display apparatus are actually fabricated. The electron emission characteristics and display characteristics on them are measured and then characteristics adjustments on them are performed with taking different predetermined high frequency components for respective electron sources or display apparatus. That is, high frequency components to be removed are determined by evaluating the electron source and display apparatus according to their usages (for example, the degree of incongruity is evaluated by actually displaying an image in the apparatus). The target vales shall be set to reduce the disadvantageous characteristics variations due to predetermined the high frequency components. It takes a lot of time to adjust the characteristics of all the devices to the same target value. Instead, it is advantageous to determine the spatial distribution of target values comprising low frequency components which roughly reflects the characteristics of the devices measured before taking the changing step (at the pre-changing). In other words, the predetermined high frequency components are at least part of components higher in frequency than the low frequencies of components which roughly reflect the characteristics distribution of the devices measured before taking the changing step. Even if the spatial distribution of the characteristics has the predetermined high frequency components in the above context, a small amplitude of variation appearing at those high frequencies is tolerable. It is not necessarily required to completely clear the predetermined high frequency components. It is one way to determine the target values so that the amplitude (magnitude) of variation of the predetermined high frequency components is reduced. When the amplitude (magnitude) of variation of high frequency components which are regarded harmful is tolerably small without the changing step, it is another way to determine the target values so that the variations of these high frequency components remains as it is.

Further, the spatial distribution of the target values has spatial frequencies and is thus not uniform. This means that the target values for changes in the characteristics of all the devices are not set the same value. If for example, the plurality of electron emitting devices are linearly arranged, when the direction in which the devices are arranged is defined as the X axis and the target values are shown on the Z axis, the line formed by the target values on the XZ plane is not a straight line with a zero inclination. Preferably, this line is a straight line with a non-zero inclination ($Z=pX$ where p is a constant) or a curve represented as function of X with a Z item having the second or later order, that is, a function including an item with the second or later power of X. If the plurality of electron emitting devices are two-dimensionally arranged, when the devices are arranged on the XY plane and the target values are shown on the Z axis, the surface formed by the target values is not a plane with a zero inclination. Preferably, this surface is a plane with a non-zero inclination or a curved surface.

The present application includes the following aspect of the invention:

That is, the present invention provides a method of adjusting a characteristic of an electron source having a plurality of electron emitting devices arranged on a substrate, the method being characterized by comprising:

a characteristic changing step of changing electron emission characteristics of the electron emitting devices, and in that in the character changing step, target values indicative of targets for changes in electron emission characteristics have a non-uniform spatial distribution, and the spatial distribution is obtained by an step of reducing predetermined high-frequency components of spatial frequencies of a spatial distribution of the electron emission characteristics of the plurality of electron emission characteristics obtained before the character changing step, and in the character changing step, the electron emission characteristics are changed so as to approach the respective target values.

Another aspect of the invention according to the present application provides a method of adjusting a characteristic of an electron source having a plurality of electron emitting devices arranged on a substrate, the method being characterized by comprising:

a characteristic changing step of changing electron emission characteristics of the display devices, and in that in the character changing step, target values indicative of targets for changes in electron emission characteristics have a non-uniform spatial distribution, and the spatial distribution is obtained by an step of smoothing the spatial distribution of the electron emission characteristics of the plurality of electron emitting devices obtained before the character changing step, and in the character changing step, the electron emission characteristics are changed so as to approach the respective target values.

Also in this aspect, the spatial distribution of the target values preferably constitutes a straight line or curve with a non-zero inclination, or a plane or curved surface with a non-zero inclination.

In the above described aspects of the invention, the operation of changing the electron emission characteristics in the character changing step preferably changes the amount of electrons emitted when a predetermined voltage is applied to the electron emitting devices.

Further, the target values are preferably obtained by subjecting the spatial distribution of the electron emission characteristics of the plurality of electron emitting devices to Fourier transform, removing predetermined high-frequency components from the resulting of the Fourier transform, and subjecting the resulting spatial frequencies to inverse Fourier transform. That is, a filtering process is executed by converting a spatial distribution into spatial frequencies.

Further, the target values are preferably obtained by subjecting the spatial distribution of the electron emission characteristics of the plurality of electron emitting devices obtained before the character changing step, to polynominal approximation to obtain an equation of a predetermined order equal to or later than the first order. This is a filter processing by use of polynominal approximating wherein some order terms among terms $x^0$, $x^1$, $x^2$ . . . $x^n$ corresponding to high frequency components to be removed are deleted in the approximated polynominal equation.

Furthermore, the target values are preferably obtained by smoothing the spatial distribution of the electron emission characteristics of the plurality of electron emitting devices obtained before the character changing step. This smoothing is preferably achieved by a convolution operation for example.

Moreover, the method preferably comprises a step of determining the target values, the target value determining step having a high-frequency component reducing step of removing predetermined high-frequency components from the spatial distribution of the electron emission characteristics of the plurality of electron emitting devices obtained before the character changing step or reducing high-frequency components of the spatial distribution, and a step of offsetting the spatial distribution obtained in the high-frequency component reducing step while maintaining the shape of the spatial distribution. If the characteristics of the electron emitting devices can change in only one direction and if some of the devices have characteristics larger than the target values while the others have characteristics smaller than the target values, then either group of devices cannot have their characteristics changed. In this case, the target values can be moved upward or downward with the shape of the spatial distribution maintained to reduce the number of devices the characteristics of which cannot be changed. The high-frequency component reducing step of removing the predetermined high-frequency components from the spatial distribution of the electron emission characteristics of the plurality of electron emitting devices obtained before the character changing step or reducing the high-frequency components of the spatial distribution can be achieved by converting the spatial distribution into spatial frequencies and filtering the spatial frequencies obtained or smoothing (filtering) the spatial distribution without a conversion into spatial frequencies.

Further, the characteristics are preferably changed by applying a voltage to the electron emitting devices. In particular, electrons are emitted from the electron emitting devices by applying a voltage to between electrodes, and the characteristics are preferably changed by applying a voltage to between the electrodes.

Furthermore, the spatial distribution of the electron emission characteristics is obtained by executing a step of measuring the electron emission characteristics of the plurality of electron emitting devices before the characteristic changing step.

Moreover, a measuring step of measuring the electron emission characteristics, a target value determining step of determining the target values, and a step of changing the electron emission characteristics can be executed for each group of electron emitting devices of the plurality of electron emitting devices.

The method preferably comprises a measuring step of measuring the electron emission characteristics of some of the plurality of electron emitting devices, a target value determining step of determining the target values for those of the plurality of electron emitting devices which have the electron emission characteristics measured in the measuring step, and a step of changing the electron emission characteristics of those of the plurality of electron emitting devices which have the electron emission characteristics measured in the measuring step. In particular, the method comprises a further measuring step of measuring the electron emission characteristics of the plurality of electron emitting devices other than those which have the electron emission characteristics measured in the measuring step, and a further changing step of changing the electron emission characteristics of the electron emitting devices that have the electron emission characteristics measured in the further measuring step, wherein in the further changing step, target values indicative of targets for changes in electron emission characteristics are determined on the basis of results of measurements in the further measuring step and results of measurements in the measuring step. With this configuration, if the characteristics are changed for each small area, they are prevented from being discontinuous at the boundary between small areas.

The electron emission characteristics of the electron emitting devices may be changed in various manners depending on the applied electron emitting devices, but the changing operation is preferably performed in an atmosphere in which the changed electron emission characteristics can be maintained. For example, when the electron emission characteristics of the electron emitting devices are changed in an atmosphere in which an organic gas undergoes a partial pressure of $1.0\times10^{-6}$ [Pa] or lower, deposits associated with the organic gas are prevented from depositing on the electron emitting devices, thereby allowing the changed characteristics to be easily maintained.

Further, the above described characteristic adjusting method can be executed with appropriate timings. For example, the above described characteristic adjustment may be carried out as required after normal driving for a while. Alternatively, it may be executed as part of a manufacture process.

The present invention includes the following method of adjusting a characteristic of an electron source having a plurality of electron emitting devices, the method comprising a characteristic changing step of changing electron emission characteristics of the electron emitting devices, wherein in the characteristic changing step, target values indication of targets for changes in electron emission characteristics are determined by reflecting a spatial distribution of electron emission characteristics of the electron emitting devices taken before the characteristic changing step on a spatial distribution of the target values whereby the total amount of the electron emission characteristic changes is less than the total amount of electron emission characteristic changes by which electron emission characteristics of all of the electron emitting devices become identical, and the electron emission characteristics are changed to approach to the respective target values.

By setting the target values so that the spatial distribution of the target values reflect the spatial distribution of the characteristics (in pre-changing) of the devices, the total amount of the characteristic changes (sum of characteristics changes performed on the respective devices) can be less than the total amount of characteristic changes by which characteristics of all of the electron emitting devices become uniform. It is preferable to roughly reflect the spatial distribution of the characteristics in pre-changing on the spatial distribution of the target values.

Furthermore, the present invention is not limited to electron sources having electron emitting devices, but is applicable to image display apparatuses using electron emitting devices as image display devices or display devices (for example, electroluminescence devices) other than the electron emitting devices.

That is, the present invention provides a method of adjusting a characteristic of an image display apparatus having a plurality of display devices, the method being characterized by comprising:

a characteristic changing step of changing electron emission characteristics of the display devices, and in that in the characteristic changing step, target values indicative of targets for changes in display characteristic are such that a spatial distribution of the target values has spatial frequencies obtained by removing predetermined high-frequency components from spatial frequencies of a spatial distribution of the display characteristics of the plurality of display devices obtained before the characteristic changing step or reducing predetermined high-frequency components of the spatial distribution, and in the characteristic changing step, the display characteristics are changed so as to approach the respective target values.

Another aspect of the invention according to the present application provides a method of adjusting a characteristic of an image display apparatus having a plurality of display devices, the method being characterized by comprising:

a characteristic changing step of changing display characteristics of the display devices, and in that in the character changing step, target values indicative of targets for changes in display characteristics have a non-uniform spatial distribution, and the spatial distribution is obtained by an step of reducing predetermined high-frequency components of spatial frequencies of a spatial distribution of the display characteristics of the plurality of display characteristics obtained before the character changing step, and in the character changing step, the display characteristics are changed so as to approach the respective target values.

Another aspect of the invention according to the present application provides a method of adjusting a characteristic of an image display apparatus having a plurality of display devices, the method being characterized by comprising:

a characteristic changing step of changing display characteristics of the display devices, and in that in the character changing step, target values indicative of targets for changes in display characteristics have a non-uniform spatial distribution, and the spatial distribution is obtained by an step of smoothing the spatial distribution of the display characteristics of the plurality of display devices obtained before the character changing step, and in the character changing step, the display characteristics are changed so as to approach the respective target values.

Additionally, the present invention includes a method of adjusting a characteristic of an image display apparatus having a plurality of image display devices, the method comprising:

A characteristic changing step of changing display characteristics of the image display devices, wherein in the characteristic changing step, target values indicative of targets for changes in display characteristics are determined by reflecting a spatial distribution of display characteristics of the electron emitting devices taken before the characteristic changing step on a spatial distribution of the target values whereby the total amount of the display characteristic changes is less than the total amount of display characteristic changes by which display characteristics of all of the image display devices become identical, and the display characteristics are changed to approach to the respective target values.

In this case, the operation of changing the display characteristics in the characteristic changing step preferably changes a luminance obtained when a predetermined voltage is applied to the display devices.

The aspect of the invention which has been described in conjunction with adjustment of a characteristic of an electron source is also applicable to adjustment of a characteristic of an image display apparatus, and still constitutes the invention according to the present application.

BRIEF DESCRIPTION OF THE DRAWINGS

FIG. 23 is an example of a convolution kernel used for the space filter processing used in an embodiment of the present invention;

DETAILED DESCRIPTION OF THE PREFERRED EMBODIMENTS

The present invention will be described in further detail based on embodiments.

[Embodiment 1]

Next, an example will be shown as an example to which the present invention has been applied to an electron source and as an example to which the present invention has been applied to an image display device in which electron emitting device has been applied as a display device. In particular, the embodiment shown here adopts surface conduction type electron-emitting device as electron emitting device.

Firstly, the construction and manufacturing method of the display panel of the image display device to which the present invention has been applied.

Figure 1:
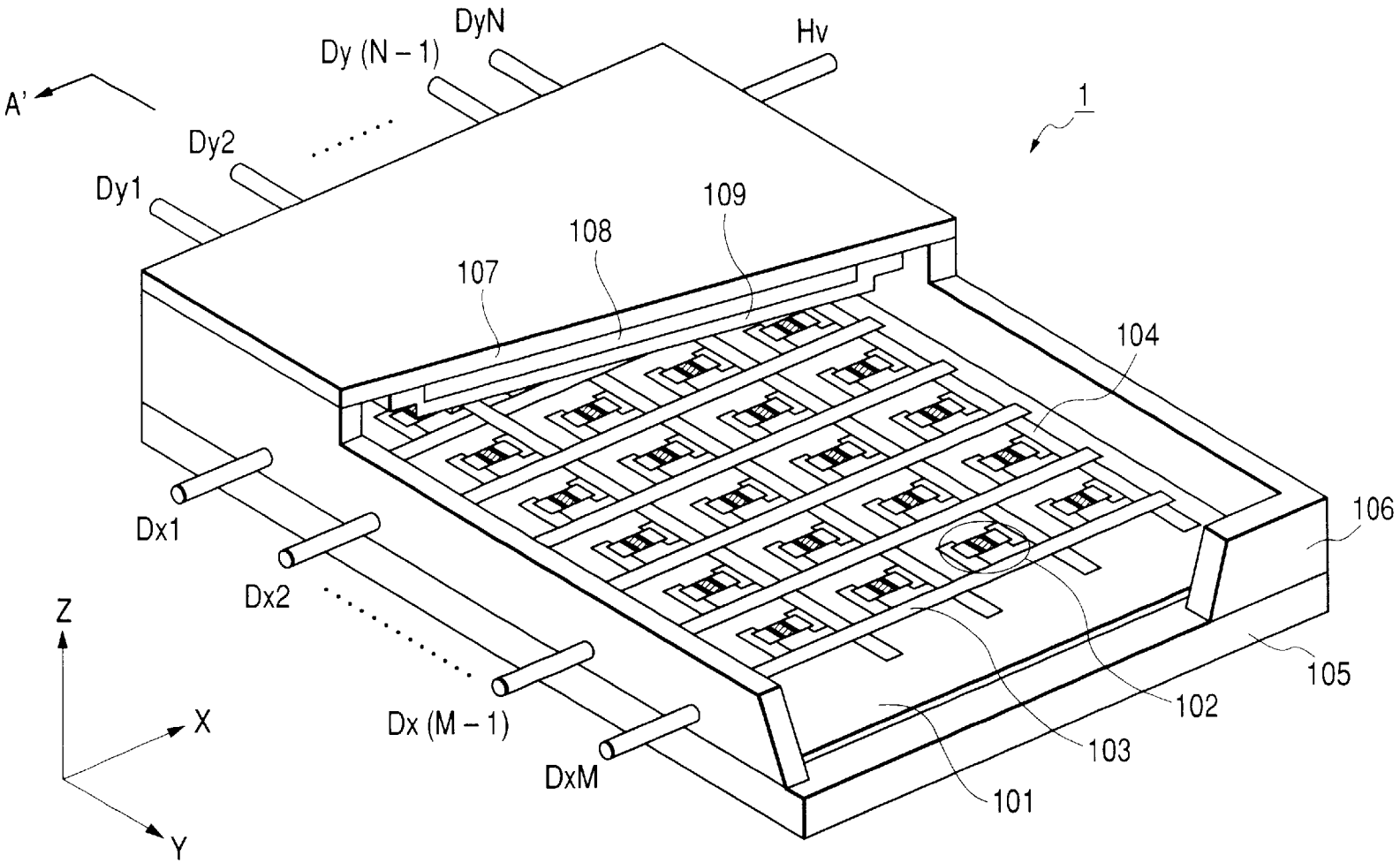
FIG. 1 is a perspective view having been partially cut off to show a portion of a display panel of an image display device being an embodiment of the present invention.

FIG. 1 is a perspective view of a display panel of an image display device to which the present invention has been applied to show a portion of the panel partially cut off for showing the internal structure.

In the drawing, reference numeral 105 denotes a rear plate, reference numeral 106 denotes a side wall and reference numeral 107 denotes a face plate, and the rear plate 105, the side wall 106 and the face plate 107 form an air-tight container to maintain a vacuum state inside the display panel. Assemble of the air-tight container should involve sealing to maintain sufficient intensity and air-tightness for the joint part of the respective members, and sealing was achieved by, for example, applying flit glass to the joint part and baking under 400 to 500° C. for not less than 10 minutes in the atmosphere or in the nitrogen atmosphere.

A substrate 101 is fixed in the rear plate 105, and on the substrate, n×m units of surface conduction type electron-emitting device 102 are formed. The n and m are appropriately set in correspondence with the target display pixel number. In the present embodiment, n and m were set at n=3000 and m=1024. A portion which are constructed with a substrate 101, a surface conduction type electron-emitting device 102, a wiring electrode in the line direction 103 and a wiring electrode in the column direction 104 will be called as multi-electron source.

Figure 2:
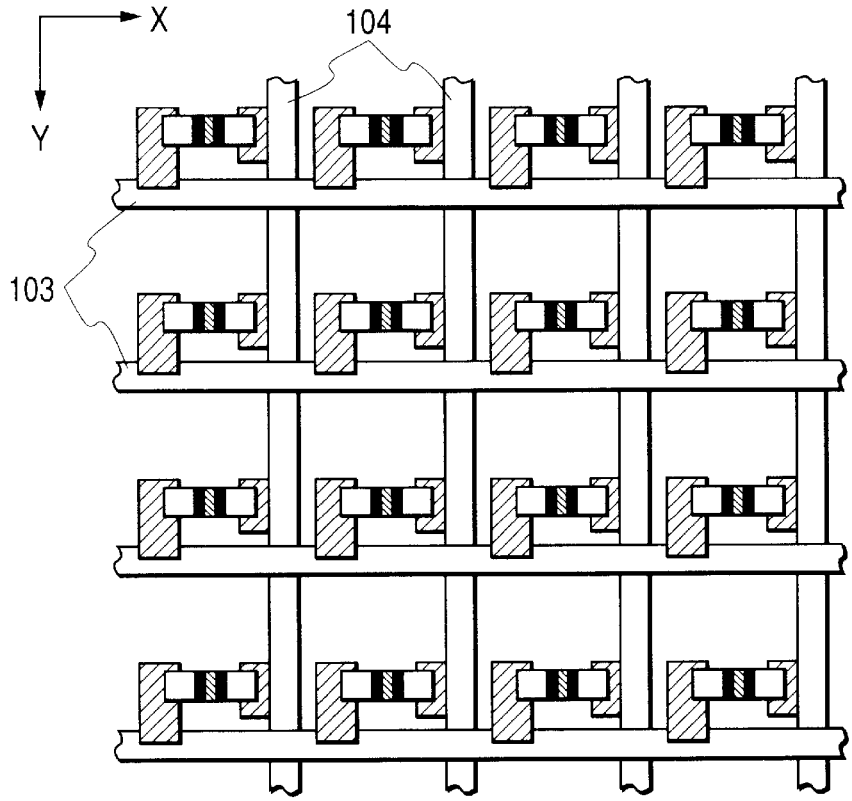
FIG. 2 is a plan view of a substrate of a multi-electron source used in the embodiment.

FIG. 2 is a plan view to show a multi-electron source. On the substrate, the surface conduction type electron-emitting devices 102 are arranged so that these devices are wired in a simple matrix with a wiring electrode in the line direction 103 and a wiring electrode in the column direction 104. The portion where the wiring electrode in the line direction 103 and the wiring electrode in the column direction 104 intersect, an insulation layer (not shown) is formed between electrodes so that electrical insulation is held.

Incidentally, the multi-electron source in such a structure was manufactured by executing conduction forming processing and conduction activating processing with respective devices being supplied with electricity via the wiring electrode in the line direction 103 as well as the wiring electrode in the column direction 104 after the wiring electrode in the line direction 103, the wiring electrode in the column direction 104, the inter-electrode insulator layer, and the tab electrode of the surface conduction type emitting tab and the conductive thin film were formed in advance.

Figure 3:
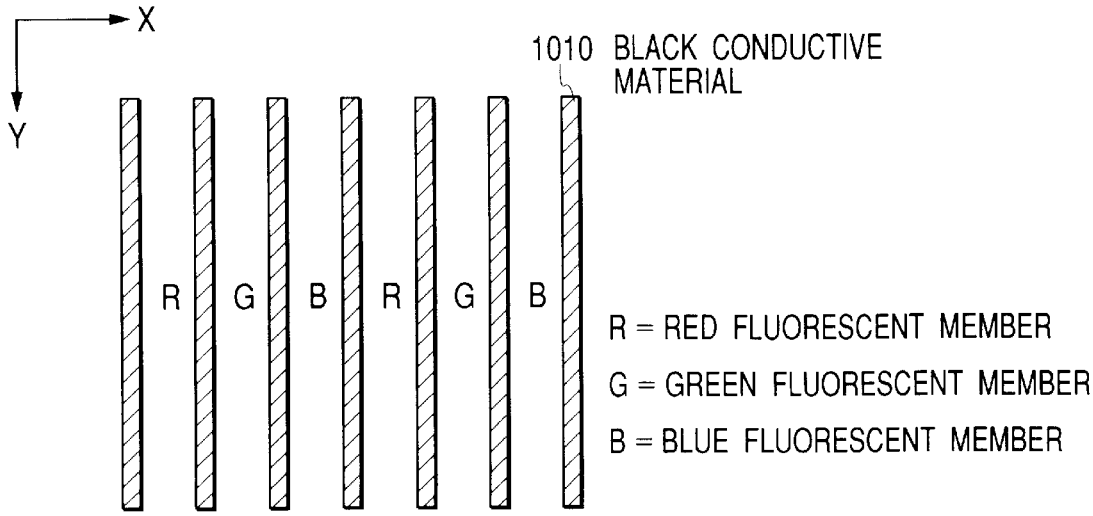
FIG. 3 is a plan view having exemplified fluorescent member arrangement of a face plate of the display panel of the present embodiment.

On the bottom surface of the face plate 107 in FIG. 1, a fluorescent film 108 is formed. Since the present embodiment is a color display device, the portion of the fluorescent film 108 is coated with three basic colors fluorescent body, namely red, green and blue that are used in the CRT field, respectively. The fluorescent bodies of respective colors are applied in a striped allocation as shown in FIG. 3, and the margin between parts of stripe of the fluorescent body comprises black conductors 1010. The purpose to provide with the black conductor 1010 is not to give rise to misplacement in display color even if there could be misplacement in irradiation position of electron beam, to prevent reflection of outside light to prevent a drop in display contrast, and to prevent charge-up of the fluorescent film due to electron beam, etc. For the black conductor 1010, graphitized carbon was used as the main component, but any material other than this may be used if it is appropriate to the above described purpose. In addition, the coating allocation of the three main colors of the fluorescent body will not be limited to the stripe arrangement shown in the above described FIG. 3, but may involve a delta arrangement or the other arrangement.

On the face of the rear plate side of the fluorescent film 108 is provided with a known metal back 109 that is known in the CRT field. The purpose that the metal back 109 was provided is to reflect at a narrow angle a part of the light that the fluorescent film 108 emits and improve optical utility rates, to protect the fluorescent film 108 from the impact of the negative ions, to let it act as an electrode to which electron beam accelerated voltage is applied and to let it act as a conductive path for electrons that have energized the fluorescent film 108, etc. The metal back 109 was formed by a method that the fluorescent film 108 was formed on the face plate substrate 107 and thereafter the fluorescent film surface underwent smoothing processing so that Al is brought into vacuum evaporation thereon.

Dx1 to Dxm as well as Dy1 to Dyn and Hv are electricity connecting terminals having air-tight structure that was provided to electrically connect the said display panel and the not shown electric circuit. Dx1 to Dxm are electrically connected with the wiring electrode in the line direction 103, Dy1 to Dyn with the wiring electrode in the column direction 104 and Hv with the metal back 109 of the face plate.

In order to pump inside the air-tight container to vacuum, the air-tight container is assembled and thereafter the not shown an exhaust tube and the vacuum pump are connected together so that the interior of the air-tight container undergoes pumping to reach a vacuum level around 1e−6 (Pa). Thereafter, the exhaust tube is sealed, and in order to maintain the vacuum level inside the air-tight container, a getter film (not shown) is formed in a predetermined position inside the air-tight immediately prior to sealing or after sealing. A getter film is a film formed by heating the getter member having, for example, Ba as the main component with a heater or high frequency heating followed by evaporation, the interior of the air-tight container is maintained to and under the vacuum level around 1e−6 (Pa) due to absorption of the getter film. That is, the state is in a stabilized mode under which the organic pressure distribution was reduced.

Preferred embodiments of the present invention will be described in detail with reference to the attached drawings as follows.

The applicants executed research for improving characteristics of surface conduction type emitting device energetically and as a consequence have found out that execution of preparatory drive processing prior to normal drive in manufacturing steps can reduce chronological changes. The preparatory drive and characteristics adjustment of the electron source were executed in an a packaged fashion in the present embodiment, the preparatory drive will be described at first.

As described above, the devices having undergone normal forming processing and conductive activation processing are maintained under the stabilized state with organic pressure distribution having been reduced. The preparatory drive is conductive processing executed prior to normal driving under such atmosphere in which pressure distribution of organic material in the vacuum atmosphere has been reduced (stabilized state).

In a surface conduction type emitting device, intensity of electric field neighboring the electron emitting part that is being driven is extremely high. Therefore long-term driving under the same driving voltage would present a problem that the emission electron quantity drops gradually. Chronological changes neighboring electron emitting part due to high electric filed intensity are presumed to result in drops in the emission electron quantity.

The preparatory drive is to drive the surface conduction type emitting device having undergone stabilizing procedure under a predetermined voltage being Vpre for a while. Driving with Vpre voltage application will drive the electron emitting part of the device in advance under large electric field intensity, and thus thereafter long-term drive under a normal driving voltage Vdrv (a normal driving voltage Vdrv is a voltage involving less intensity of electric field than the intensity of electric field at the time of application of the Vpre) will hardly change the electron emitting characteristics. It can be assumed that the improvement is achieved because the state change of the structural member causing the aging characteristics takes place intensively within the short time, resulting in the reduction of the change factors.

In the present embodiment, the characteristics adjustment was executed prior to normal driving so that in an electron source having dispersion in characteristics of each surface conduction type emitting device at the time when the normal driving voltage Vdrv has been applied that dispersion has gradual two-dimensional (inter-plane) distribution. (The method for characteristics adjustment will be described below.)

Figure 4:
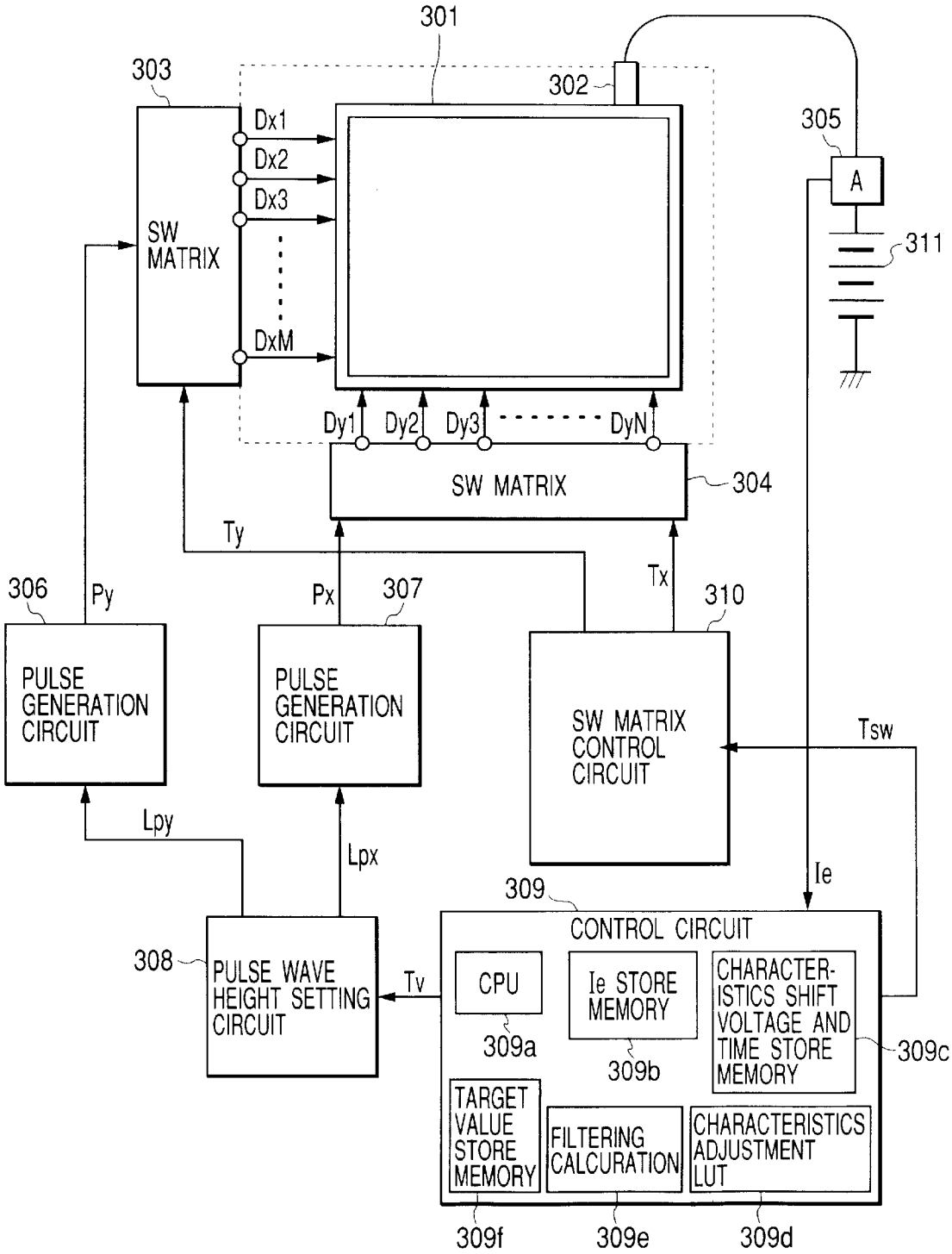
FIG. 4 is a schematic view of a device, which relates to the embodiment 1 of the present invention to apply characteristics adjustment signals to the multi-electron source.

FIG. 4 is a block diagram showing construction of a drive circuit (characteristics adjustment device) for changing electron emitting characteristics of the respective surface conduction type emitting devices of the electron source substrate by applying wave signals for characteristics adjustment to each surface conduction type emitting device of the display panel 301.

In FIG. 4, the display panel 301 is provided inside a vacuum container with a substrate where a plurality of surface conduction type emitting devices are disposed to form a matrix and a face plate which is provided remote on that substrate and has fluorescent members emitting lights with electrons emitted from surface conduction type emitting device and the like. Prior to characteristics adjustment, the preparatory drive voltage Vpre has been applied to the each device of the display panel 301. Reference numeral 302 denotes a terminal for high voltages being applied from the high voltage supply 311 onto the fluorescent member of the display panel 301. Reference numerals 303 and 304 denotes switch matrix, which respectively are for selecting wiring in the line direction and wiring in the column direction and applying pulse voltage to the selected wiring. The switch matrix applying pulse signals selectively to the wiring in the line direction and the wiring in the column direction makes it possible to selectively apply a desired voltage to a desired surface conduction type emitting device. Reference numeral 306 and 307 denote pulse generation circuit which generate pulse wave signals Px and Py for driving. Reference numeral 308 denotes a pulse wave height setting circuit, which determines wave height values of pulses outputted respectively from the pulse generation circuits 306 and 307 by outputting pulse setting signals Lpx and Lpy. Reference numeral 309 denotes a control circuit, which controls the entire characteristics adjustment flow and outputs data Tv for setting the wave height value to the pulse wave height setting circuit 308. Incidentally, reference numeral 309*a* denotes a CPU, which controls operations of the control circuit 309. Reference numeral 309*b* denotes a memory for storing characteristics of each device for characteristic adjustment of each device. In particular, the memory 309*b* normally stores the electron emitting quantity Ie that are emitted from each device at the time of application of the drive voltage Vdrv. Reference numerals 309*d* and 309*e*, details of which will be described later, denote circuits to execute two dimensional space filter calculation on the look up table (LUT) for reference to implement characteristics adjustment of device and on the device characteristics distribution so as to calculate the adjustment target value. Reference numeral 309*f* denotes a target value store memory to store the adjustment target value for each surface conduction type emitting device. Reference numeral 309*c* is a memory to store characteristics shift voltages necessary for achieve the target set value 309*f*. Reference numeral 310 denotes a switch matrix control circuit, which outputs switch switching signals Tx and Ty to control selection of switches of the switch matrix 302 and 303 and thereby selects the surface conduction type emitting device to which the pulse voltages are applied.

Next, operation of this drive circuit will be described. Operation of this circuit has a stage to measure electron emission current of each surface conduction type emitting device of the display panel 301 so as to set an adjustment target value and a stage to apply a pulse wave signal for characteristics shift so as to reach the adjustment target value.

At first, a method to measure the emission current Ie will be described. From the control circuit 309, the switch matrix control signal Tsw is outputted, and according to the switch matrix control signal outputted from the switch matrix control circuit 310, the switch matrix 303 and 304 select the predetermined wiring in the line direction or wring in the column direction for switching connection so that the desired surface conduction type emitting device can be driven.

On the other hand, the control circuit 309 outputs the wave height value data Tv for measuring the electron emission characteristics to the pulse wave height value setting circuit 308. This causes the pulse wave height value setting circuit 308 to output the wave height value data LPx as well as Lpy to the pulse generation circuits 306 and 307 respectively. Based on this wave height value data Lpx as well as Lpy, the pulse generation circuit devices 306 as well as 307 respectively output the drive pulse Px as well as Py and this drive pulse Px as well as Py is applied to the device selected by the switch matrix 303 as well as 304. Here, this drive pulse Px as well as Py is set in the surface conduction type emitting device to form a pulse having a half amplitude of the voltage (wave height value) Vdrv applied for characteristics measurement and polarity different from each other. In addition, at the same time, a predetermined voltage is applied to the fluorescent member of the display panel 301 with the high voltage power supply 311. And the emission current Ie at the time when the surface conduction type emitting device is driven with these drive pulses Px and Py are measured with a current detector (measurement device) 305.

Figure 6:
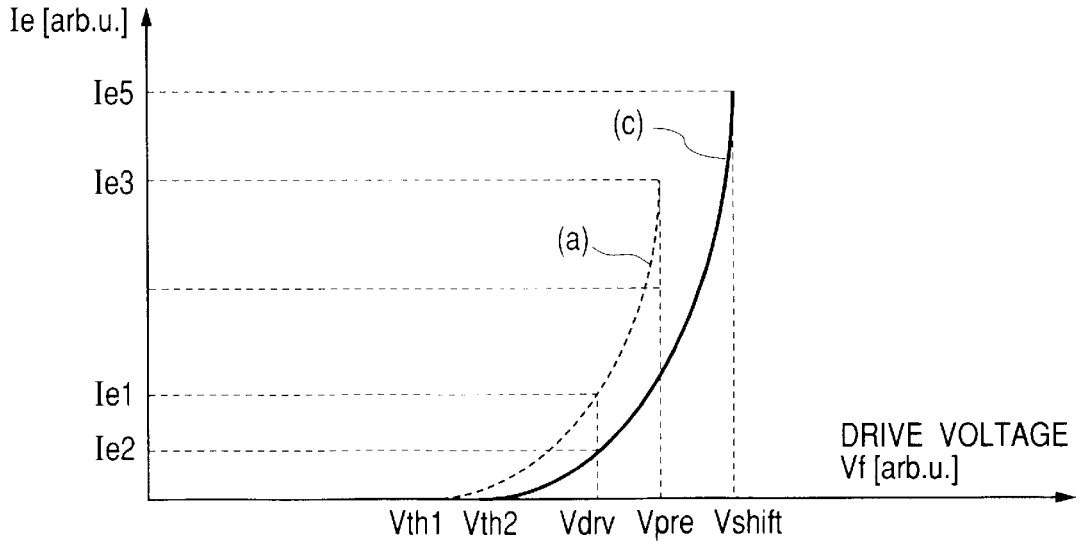
FIG. 6 is a drawing having shown change in emission current characteristics when characteristics shift voltage has been applied to an device having the emission current characteristics (a) in FIG. 5.

Next, the characteristics adjustment method used in the present embodiment will be described with reference to FIG. 6 schematically.

Figure 5:
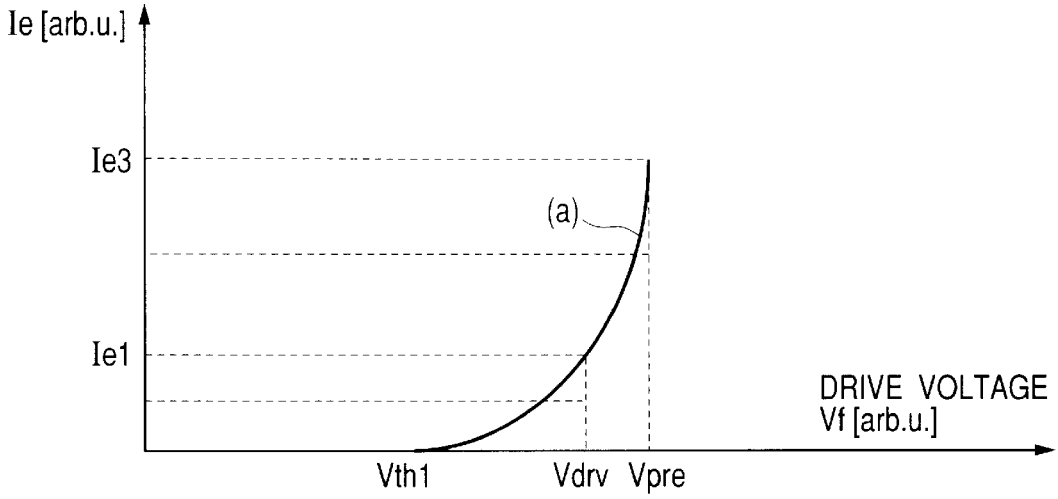
FIG. 5 is a drawing having shown an example of the emission current characteristics when the driving voltage of each surface conduction type electron-emitting device is changed to which a preparatory driving voltage has been applied.

FIG. 5 is a drawing to show an example of emission current characteristics when the drive voltage (the wave height value of the drive pulse) Vf of each surface conduction type emitting device to which the preparatory drive voltage height value Vpre has been applied during the step of producing the multi-electron source of the display panel 301 of the present embodiment.

In the said drawing, the emission current with the drive voltage Vdrv of the surface conduction type emitting device having the electron emission characteristics shown by the operation curve (a) will be Ie1.

On the other hand, the surface conduction type emitting device of the present embodiment has the emission current characteristics (memory function) corresponding with the maximum wave height value as well as the pulse width of the drive pulse of the voltages applied in the past.

FIG. 6 shows how the emission current characteristics varies at the time when characteristics shift voltage Vshift (Vshift≧Vpre) is applied to the device having the emission current characteristics of the curve (a) shown in FIG. 5. With the application of the characteristics shift voltage, it is found out that the emission current Ie at the time of application of Vdrv is reduced from Ie1 to Ie2. That is, the emission current characteristics will shift rightward (in such a direction that the emission current become small) due to application of the characteristics shift voltage. Also in the present embodiment, such characteristics adjustment was executed.

Incidentally, in order to know how much the characteristics curve shifts rightward with application of how many voltages for characteristics shifting toward the surface conduction type emitting device having a certain initial characteristics, the surface conduction type emitting device having various initial characteristics were selected and various amounts of Vshift were applied thereto for experiments so that various data have been stocked. Incidentally, in the apparatus in FIG. 4, these data are stocked in advance in the control circuit 309 as a look-up table 309*d*.

Figure 7:
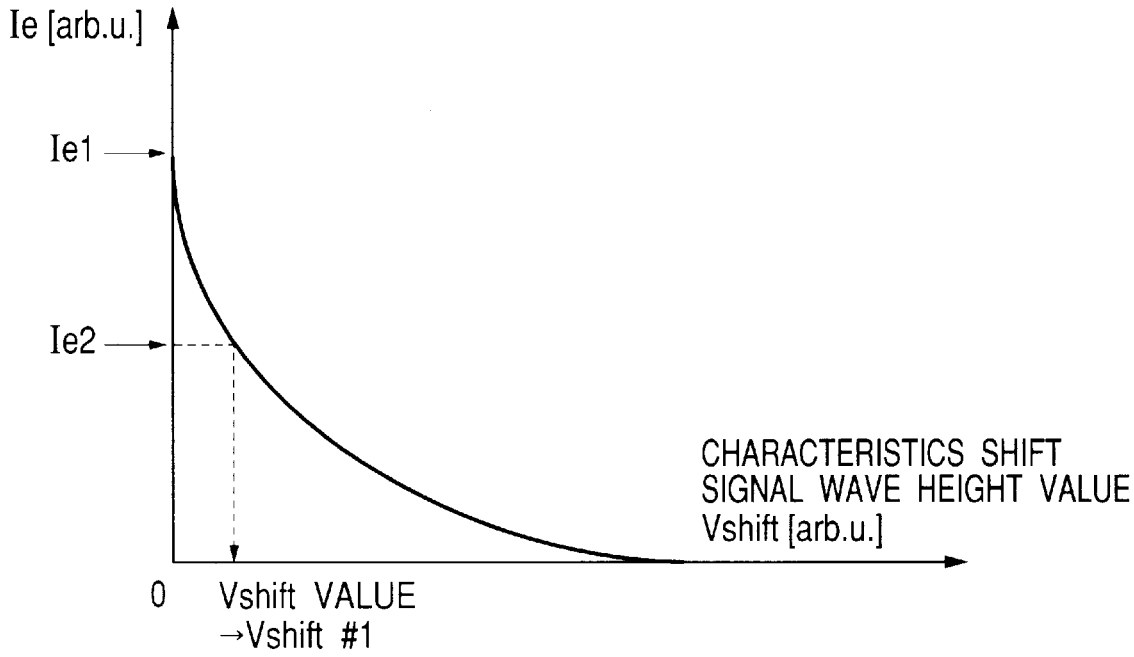
FIG. 7 is a view having shown characteristics shift pulse voltage wave height values and emission current changes.

FIG. 7 shows as a graph with data of the surface conduction type emitting device having the same initial characteristics as the initial characteristics shown with the curve (a) in FIG. 5 being picked up from the above described look-up table. The horizontal axis of this graph expresses the amount of the characteristics shift voltage and the vertical axis expresses the emission current Ie. This graph is a result (the vertical axis) in which the emission current was measured when the drive voltage of the same amount as Vdrv was applied after the characteristics shift voltage (the horizontal axis) was applied. Accordingly, in order to determine for the device having the characteristics of the curve (a) in FIG. 5 with the current Ie1 having flowed at the time of application of Vdrv the amount of the characteristics shift voltage to be applied so that the current at the time of application of Vdrv becomes Ie2, the only thing to do is to read the Vshift value in such a point that the Ie is equal to Ie2 in the graph in FIG. 7. (Vshift#1 in the drawing)

Figure 8:
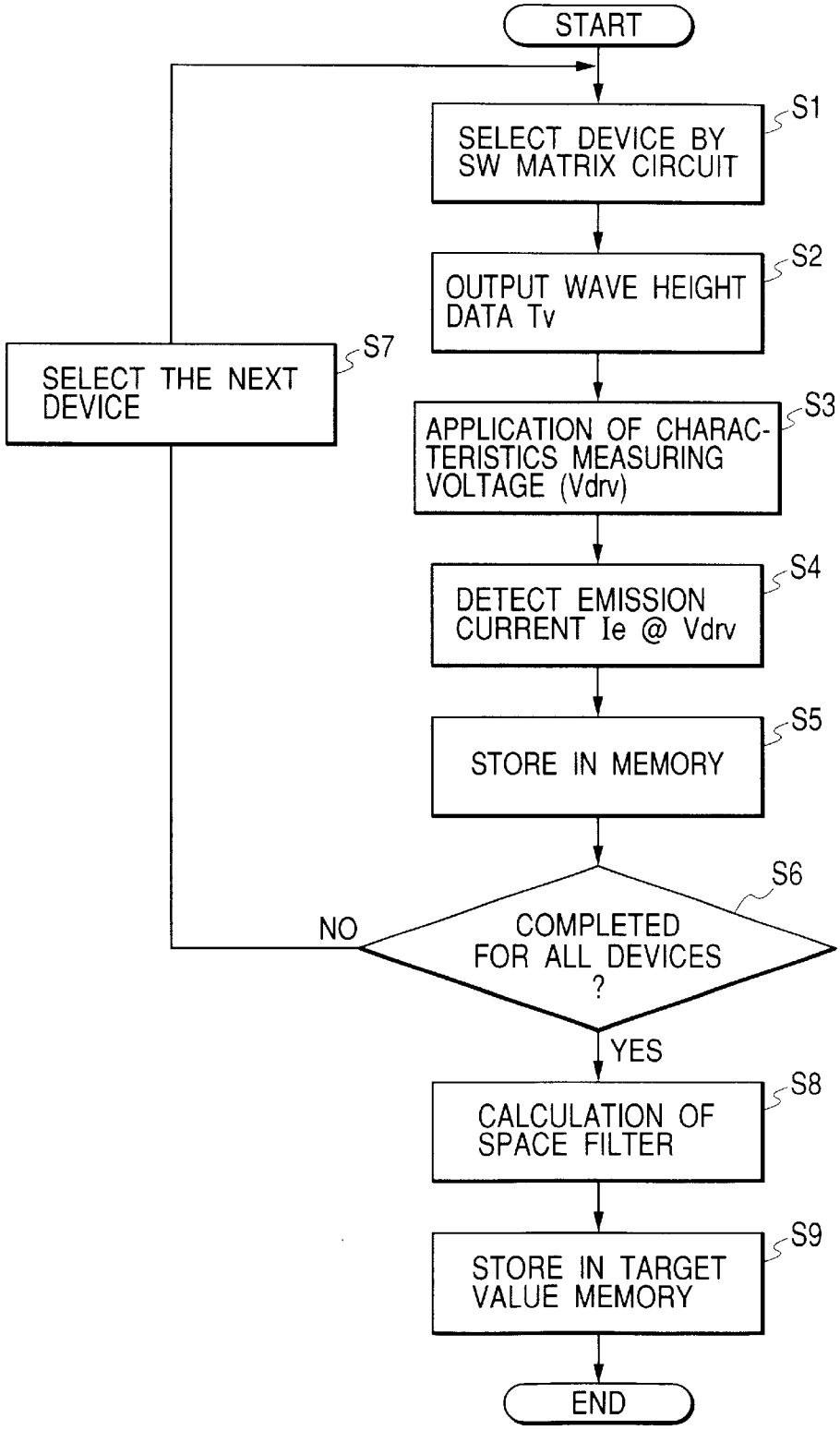
FIG. 8 is a flow chart showing electron emitting characteristic of each surface conduction type electron-emitting device of the electron source of the present embodiment.

FIG. 8 is a flow chart showing from characteristics measurement processing to setting of the adjustment target value with the control circuit 309.

At first, the switch matrix control signal Tsw is outputted in Step S1 and the switch matrix 303 and 304 are switched with the switch matrix control circuit 310 so that one device of the surface conduction type emitting device of the display panel 301 is selected. Next, in Step S2, the wave height value data Tv of the pulse signal applied to that selected device is outputted to the pulse wave height value setting circuit 308. The wave height value of the pulse for measurement is the drive voltage Vdrv at the time of displaying images. In addition, in Step S3, with the pulse generation circuits 306 and 307 via the switch matrix 303 and 304, the pulse signals for characteristics measurement of the electron emission device are applied to the surface conduction type emitting device selected in Step S1. Next, in Step S4, the electron emission current Ie at this time is detected to be stored in the memory 309*b* in Step S5.

In Step S6, it is checked whether the measurement was executed or not on all the surface conduction type emitting device of the display panel 1, and if not, the step goes forward to Step S7 so that the switch matrix control signal Tsw to select the next surface conduction type emitting device is outputted and the step goes forward to Step S3.

On the other hand, in Step S6, when the measurement processing on all the surface conduction type emitting device has been finalized in Step S6, the step goes forward to Step S8 and the two dimensional space filter processing in the filter calculation circuit 309*e* from the distribution of the emission current Ie toward all the surface conduction type emitting device of the display panel 1 is executed. An example of the filter curve calculation circuit in the two dimensional space (plane) will be described.

Figure 9A:
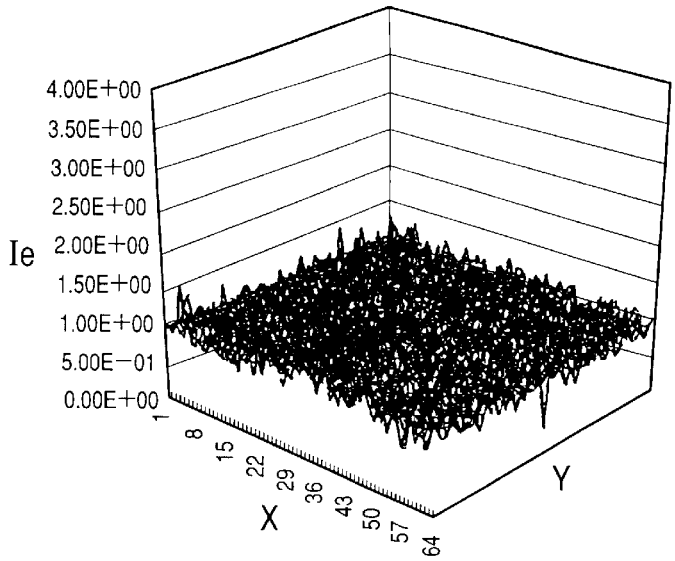
FIGS. 9A, 9B and 9C are views to describe two dimensional space filter processing to be calculated from the characteristics value of the Ie used in the present embodiment 1.
Figure 9B:
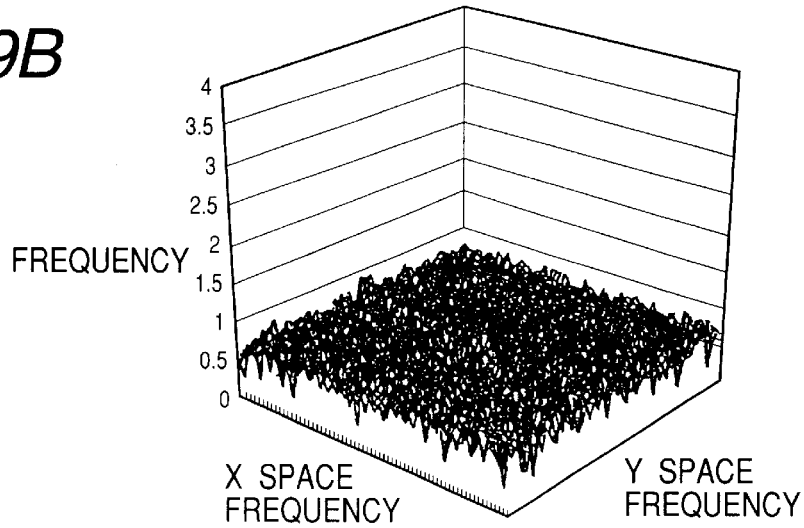

FIG. 9A is to display two dimensional space distribution of the Ie value (the electron emission characteristics in this embodiment) of each electron emission device, and at first the FFT processing is executed on this measurement values FIG. 9B. Next, the result consists of a number of frequency components, the high frequency components are removed among that plurality of frequency components so that the low frequency components are extracted. On the low frequency components the reverse FFT processing is executed as in FIG. 9C so that the low frequency components of the device characteristics space distribution are extracted. Offsetting is added to such obtained low frequency space distribution image of Ie based on the condition of the individual target setting value of each device≦the measurement values of each device (S4 in FIG. 8) to be treated as the individual target setting value of each device. This is for executing characteristics adjustment in such a direction that the Ie is reduced as described above. And this individual target setting value was stored in the memory 309*f*.

Next, from the look-up table 309*d*, the data of the device with the initial characteristics closest to the said device are read out.

In addition, from the data, the characteristics shift voltage for equalizing the characteristics of that device to the target value 309*f* is selected (reference should be made to the description in the above described FIG. 7). Thus, on each device, the value of voltage for characteristics shift is determined and the result thereof is caused to be stored into the memory 309*c* in Step S9. Incidentally, as for the device not necessary to undergo characteristics shift, the identification information that the voltage of characteristics shift is not necessary is stored into the memory 309*c*.

Figure 10:
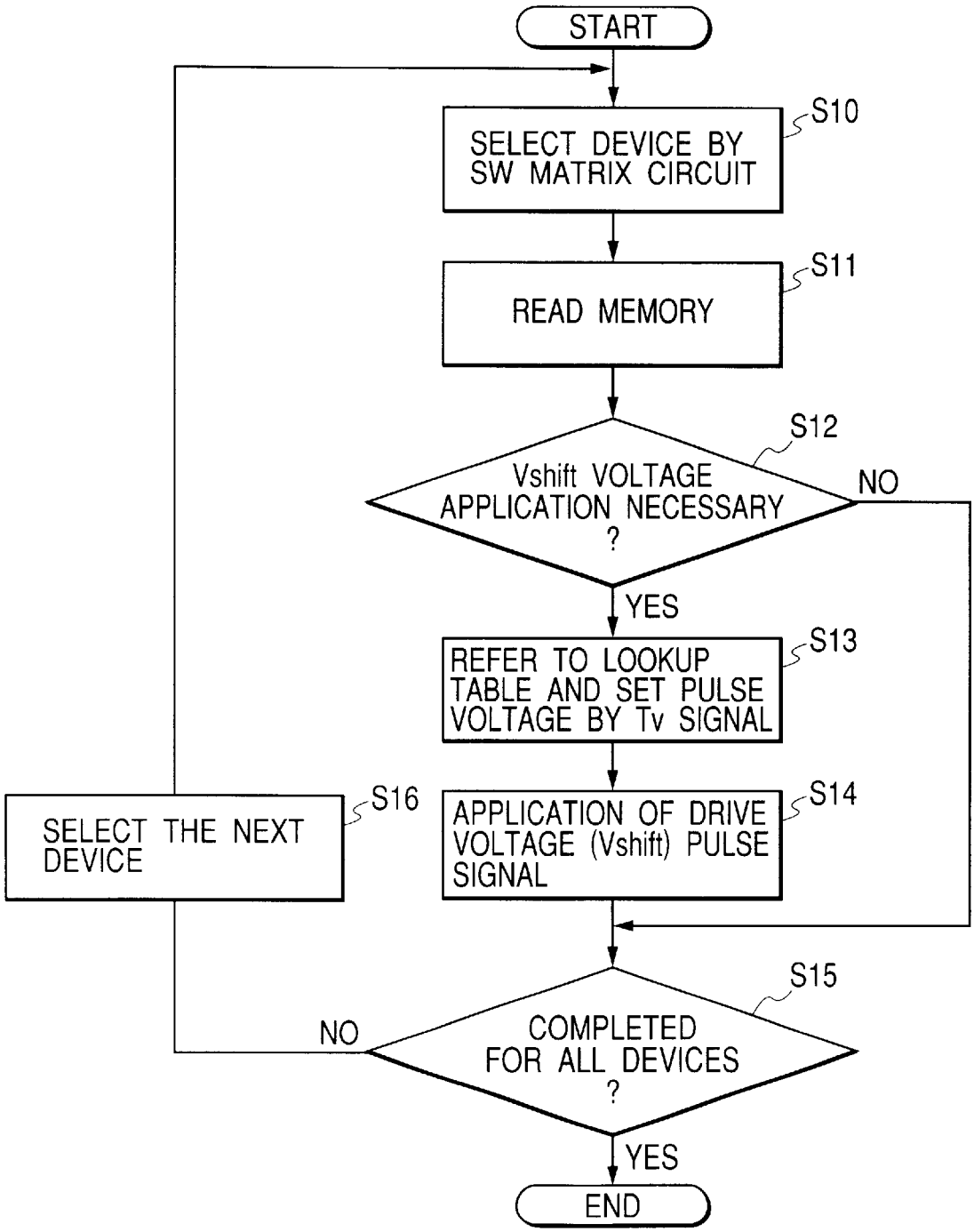
FIG. 10 is a flow chart to show a processing to apply the characteristics adjustment signals based on the measured electron emitting characteristic.

FIG. 10 is a flow chart showing processing, which is executed with the control circuit 309 of the present embodiment, to make uniform the electron emission characteristics of all the surface conduction type emitting device of the display panel 301 with the target setting value 309*f*.

At first, in Step S10, the switch matrix 303 as well as 304 is controlled with the switch matrix control signal Tsw via the switch matrix control circuit 310 so that one device of the surface conduction type emitting device of the display panel 301 is selected. Next, the step goes forward to Step S11, and the characteristics shift voltage value corresponding with that selected surface conduction type emitting device is read from the memory 309*c*. In addition, in Step S12, it is judged whether or not application of the characteristics shift voltage to that surface conduction type emitting device is necessary.

Without application of the characteristics shift voltage, the step goes forward to Step S15, but when application is necessary, the step goes forward to Step S13 so that the wave height value of the pulse signal is set by the wave height value setting signal Tv with the pulse wave height value setting circuit 308, and in Step S14, the pulse wave height value setting circuit 308 outputs the wave height value data Lpx as well as Lpy and based on that value the pulse generation circuit 306 as well as 307 outputs the drive pulses Px as well as Py of that set wave height value. Thus, the characteristics shift pulse corresponding with those characteristics is applied to the surface conduction type emitting device selected in Step S14. In Step S15, whether or not processing on all the surface conduction type emitting device has been finalized is checked in Step S15, and if not, the step goes forward to Step S16 so that the switch matrix control signal Tsw is outputted for selecting the surface conduction type emitting device booked for next application of the wave signal for memory.

Here, the shift means are constructed by the control circuit 309, the pulse wave height value setting circuit 308 and the pulse generation circuits 306 and 307. In addition, the control circuit 309 also constructs the voltage value changing means as well the voltage application time changing means.

The present embodiment involves Vdrv=14 v, Vpre=16 v and Vshift=16 to 18 v (the setting is set as above corresponding with characteristics prior to changing step of each device) and the rectangular pulse with the pulse width 1 ms and the period 3 ms. Incidentally, in the present embodiment, the electron emission current was measured for executing characteristics adjustment, but it may be arranged that light-emission luminance of the fluorescent member emitting lights with the electrons emitted from the surface conduction type emitting device is measured and this is corrected in the case where there is dispersion in luminance. That is, every time when each surface conduction type emitting device is driven, light-emission luminance of the fluorescent member that emits light with electrons emitted from the said surface conduction type emitting device is measured so that that measured luminance is transferred into a value equivalent to the above described emission current and thereby characteristics adjustment can also be realized. Since the light-emission luminance is determined corresponding with the incident electron quantity into the fluorescent member, the measured light-emission luminance indicates the electron emission characteristics. Accordingly, the light-emission luminance may be stored in the memory as is to be used for calculation of the target value without being transferred into the value equivalent to the emission current.

Figure 9C:
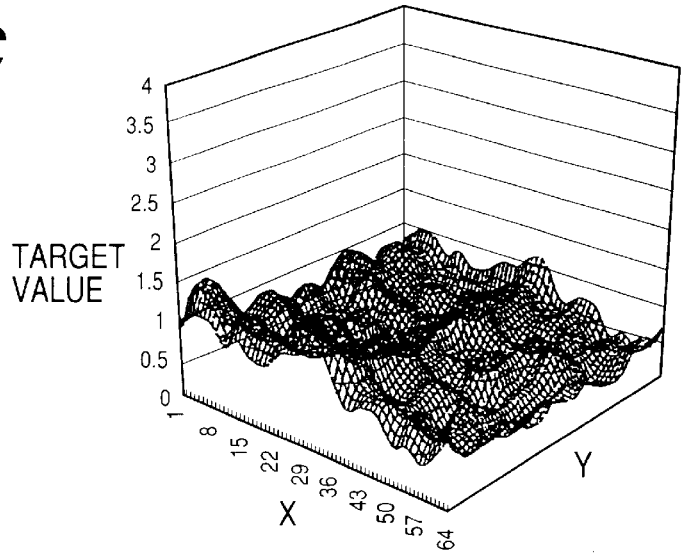

As a result of execution of the above described characteristics change step, the electron emission characteristics distribution after the characteristics adjustment will be a distribution controlled in dispersion of the adjacent devices and only with a large undulation left as shown in FIG. 9C. With removal of the high frequent components among the space distribution of the dispersion of the devices, an observer no longer perceives the characteristics dispersion in terms of vision with this electron source as the image display apparatus. In addition, execution of the characteristics adjustment did not give rise to any significant drop in luminance at last.

[Embodiment 2]

Next, the second embodiment of the present invention will be described.

Since the apparatus construction for make uniform the electron emission characteristics of each surface conduction type emitting device of the display panel 301 along a certain target setting value is common with the construction in the above described FIG. 4, description on them will be omitted.

In the present embodiment, after measuring the electron emission characteristics of each electron emission device, one-dimensional space filter processing was executed per line unit so that the adjustment target value of the electron emission characteristics was set.

In addition, the characteristics adjustment was executed not by adjusting the wave height value of the characteristics shift voltage as in Embodiment 1 but by adjusting the application time of the characteristics shift voltage. This utilizes correlation between the application time of the characteristics shift voltage and the characteristics shift quantity.

Figure 11:
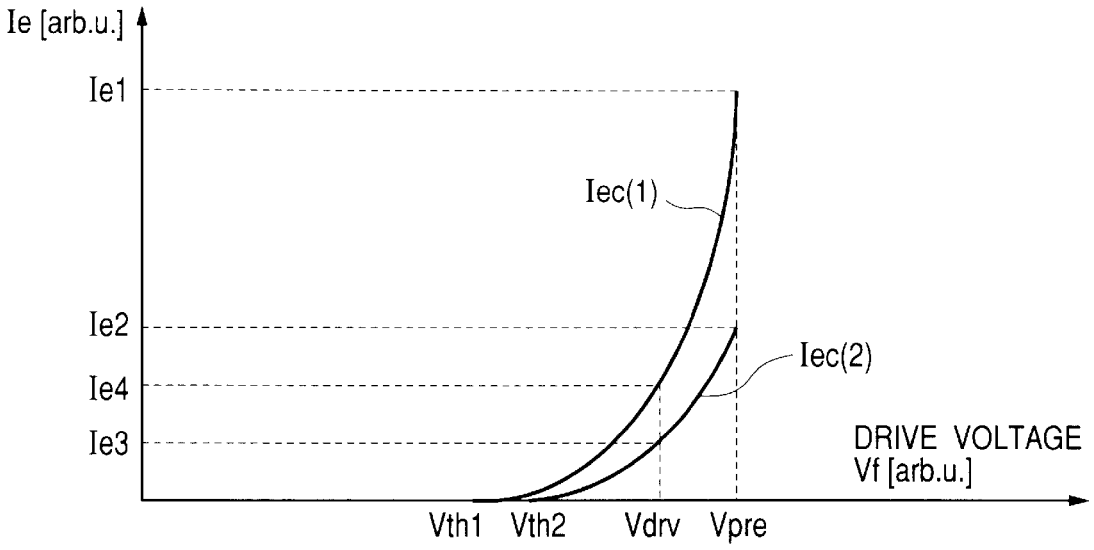
FIG. 11 is a graph having shown emission current characteristics before and after pulses were applied for the period of "Pulse #1" for characteristics shift pulse.
Figure 12:
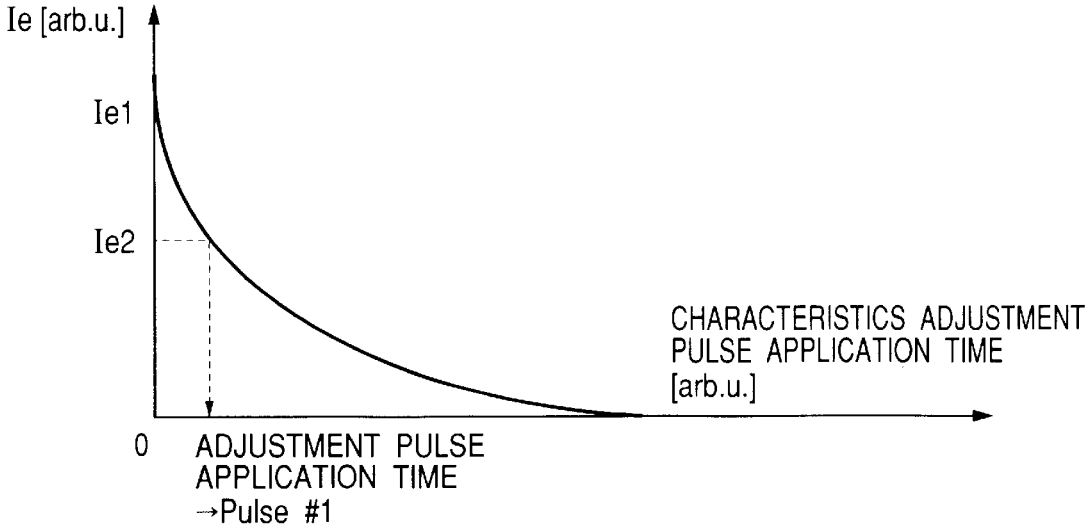
FIG. 12 is a graph to show characteristics shift pulse application time and emission current changes.

FIG. 11 is a graph showing the emission current characteristics (Iec(2) in the figure) at the time when the Vpre application voltage was applied only during the time of "Pulse-#1" for adjustment further to the electron emission characteristics (Iec(1) in the figure) after application of the preparatory drive voltage Vpre for a predetermined time. The device that was observing the emission current of Ie4 at the time of application of the Vdrv initially undergoes characteristics shift so as to observe the emission current of the Ie3 at the time of application of Vdrv after application of the characteristics adjustment pulse voltage. Accordingly, as in Embodiment 1, storing into the look-up table the graph showing the characteristics shift pulse application time and the emission current changes as shown in FIG. 12, characteristics adjustment will become possible.

In this Embodiment 2, a point that is different from Embodiment 1 is that the target value was set subject to one-dimensional filter processing per line.

In the present embodiment, electro emission characteristics distribution was different from Embodiment 1, but was generally the same in terms of line unit. Therefore, the target value setting was processed every single line so that the individual target value was set.

Figure 13A:
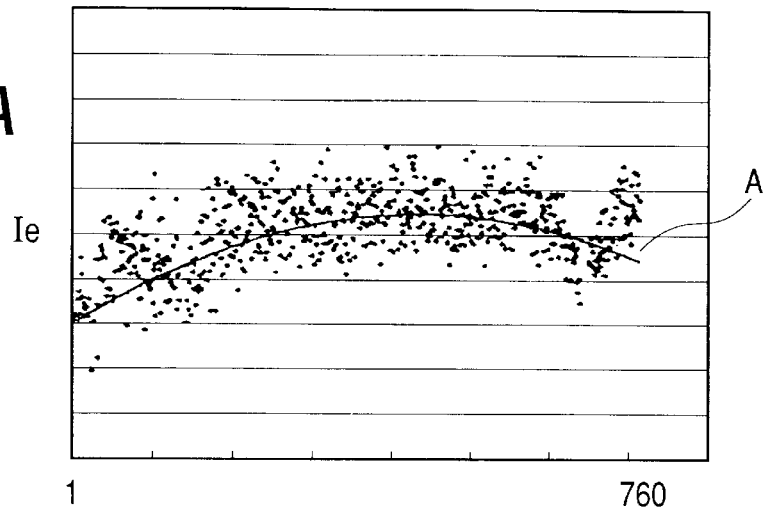
FIGS. 13A, 13B and 13C are views to describe one-dimensional filter processing to implement calculation from the characteristic value of the Ie used in the present embodiment 2.
Figure 13B:
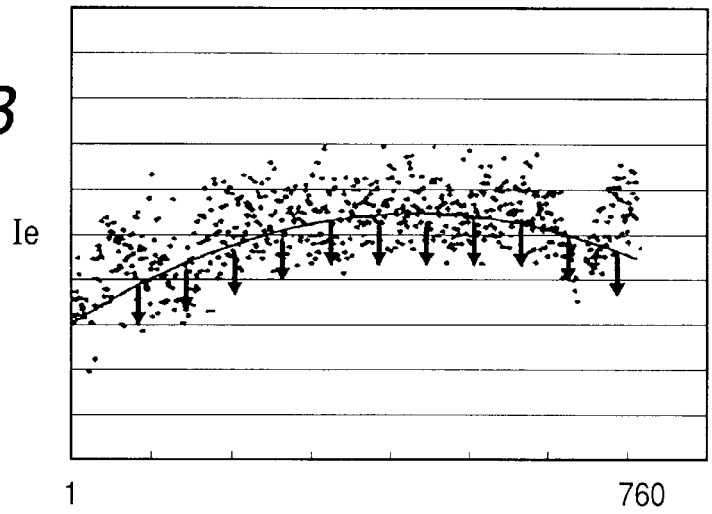
Figure 13C:
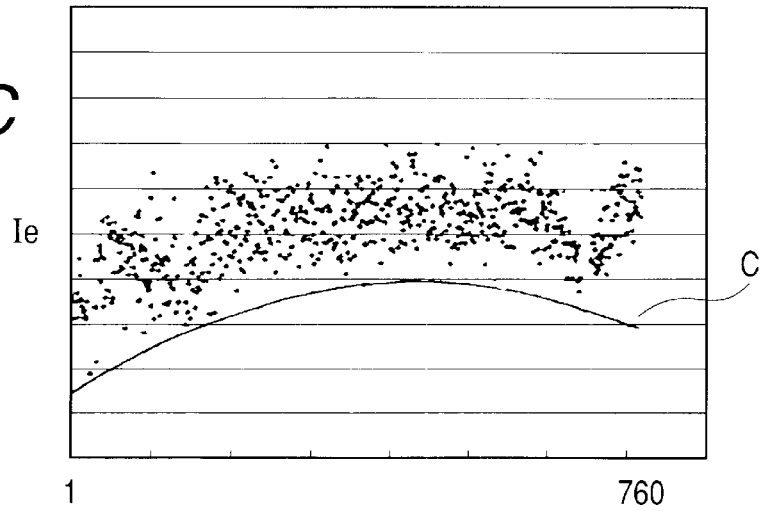

FIGS. 13A, 13B and 13C are examples at the time when filter curve calculation (along the line where a plurality of devices as target value calculation object are disposed) was executed, and the calculation method on the filter curve for one-dimensional in lines will be described.

FIG. 13 is one in which the measurement values of Ie of the surface conduction type emitting device in 1 line were made into graphs, and calculation of the characteristics adjustment filter was executed by concentrating on only lines among lines or columns.

At first, after the direction of the filter on lines or columns has been determined, for Ie measurement distribution of each surface conduction type emitting device in one line, calculation of approximated curve by way of polynominal approximation method as in the curve A shown in FIG. 13A for example (the curve equation in the example will become $y=-3\times10^{-6}x^2+0.0023x+0.5988$, wherein reference character y denotes the target value and reference character x denotes the position of each device on the lines) is executed so that the low frequency space distribution information within lines is extracted. That is, the dimension in the polynominal approximation is limited up to two dimensions so that the high frequency components over three dimensions have been removed. Incidentally, in case of dimensions not more than 0 dimension, all the devises will use one target value with y=a constant, and the space distribution of the target value will not have any frequency components. Accordingly, in case of executing target value setting with polynominal approximation, the polynominal up to a predetermined dimension not less than 1 dimension is used.

The approximation curve calculated here is caused to offset the curve A under the condition of "individual target setting value≦measurement value of each device" in the direction of the arrow shown in FIG. 13B. That is, the curve A is moved while maintaining that shape so that the curve C after that movement will not exceed the measurement value in any point. The curve C shown in FIG. 13C is the one subject to offset on the curve A. The value of the corresponding position for each device on this curve C is treated as the target set value for each electron emission device and is written into the target value memory 309*f* in FIG. 4. In addition, the measurement result of the Ie of each surface conduction type emitting device is compared with the target value of each surface conduction type emitting device so that the target shift quantity on all the surface conduction type emitting device is determined.

In the present embodiment, as described above, the characteristics shift pulse application time is changed corresponding with the target values (here in particular, the number of application time of the pulse signal having a predetermined wave height value and a predetermined pulse width is changed corresponding with the target value) so that characteristics adjustment is executed. Therefore, the graph as shown in FIG. 12 is stored in the look-up table 309*d* on how much the characteristics curve shifts with how much characteristics shift pulse time being applied to the surface conduction type emitting device having a certain initial characteristics.

In addition, the shift pulse application time necessary for shift each device to the target value 309*f* is stored in the memory 309*c*. Since the flow of characteristics adjustment is the same as in Embodiment 1, description thereon will be omitted.

The present embodiment involves Vdrv=14 v, Vpre=16 v and the rectangular pulse with the pulse width 1 ms and the period 3 ms.

[Embodiment 3]

Next, the third embodiment of the present invention will be described.

Since the apparatus construction for making uniform the electron emission characteristics of each surface conduction type emitting device of the display panel 301 along a certain target setting value is common with the construction in the above described FIG. 4, description on them will be omitted.

In the present embodiment, the method of executing filter processing after measurement of the electron emission characteristics of each surface conduction type emitting device is common with the filter processing in Embodiment 2. However, in the step of setting the target value after the filter processing, offsetting is not added based on the condition of the individual target setting value of each device≦the measurement values of each device (S4 in FIG. 8) as in Embodiment 1 or 2 but the target setting value subject to the condition of "the individual target setting value of each device≦the average value of the measurement values of each device" was set as the adjustment target value of the electron emission characteristics. The above described embodiments is arranged to undergo quality change of characteristics under stabilized state (a state in which the direction of characteristics change of devices moves practically in one direction, and is arranged to hardly move in the other direction. In particular, here, this state has been realized by improving the vacuum level in the atmosphere where devices (namely, the pressure is caused to decrease) are disposed.) and characteristics are changed in such a direction that the measurement value under the same condition will drop (the direction that the emission current value and luminance value when the same measurement voltage has been applied will drops), and thus this offset condition is to permit partial existence of devices that are not adjusted so that the characteristics approach the target value.

That is, in this Embodiment 3, the method to determine the offset quantity in the stage to set the target value after calculation of the filter curve is different from Embodiment 1 and Embodiment 2.

The characteristics adjustment was executed by the method of adjusting the application time of the characteristics shift voltage as in Embodiment 2.

Figure 14A:
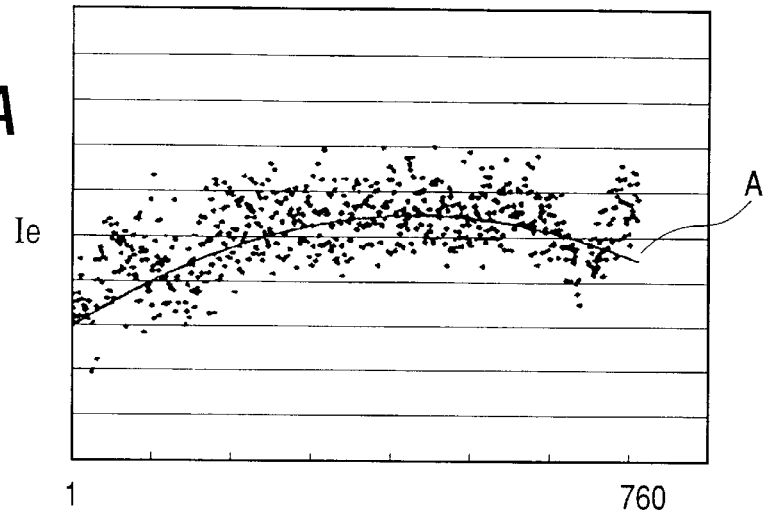
FIGS. 14A, 14B and 14C are views to describe one-dimensional filter processing to implement calculation from the characteristic value of the Ie used in the present embodiment 2.
Figure 14B:
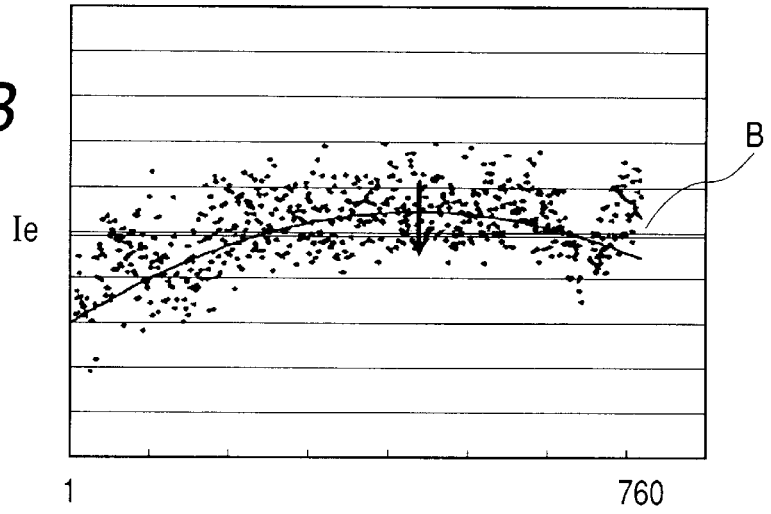
Figure 14C:
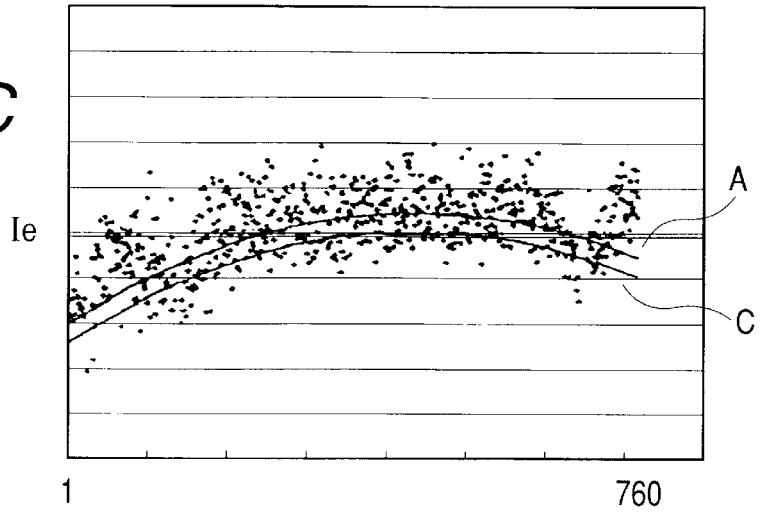
Figure 15:
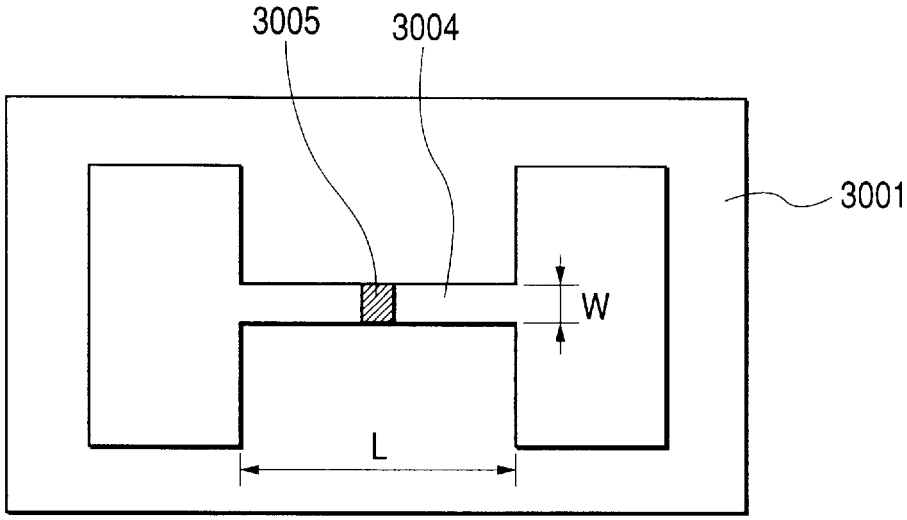
FIG. 15 is a view to show a construction of a prior art surface conduction type electron-emitting device.
Figure 16:
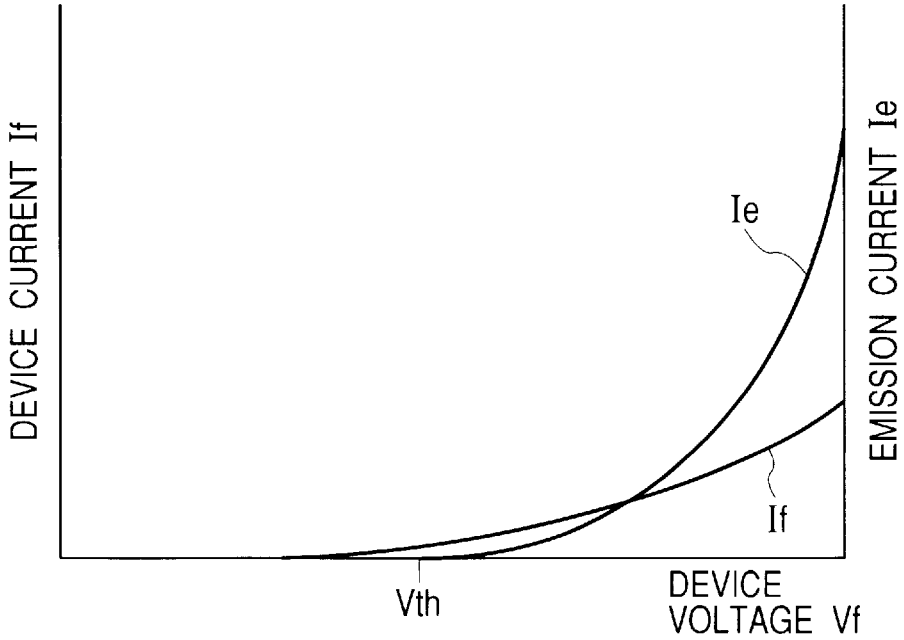
FIG. 16 is a view to show an example of surface conduction type electron-emitting device.
Figure 17:
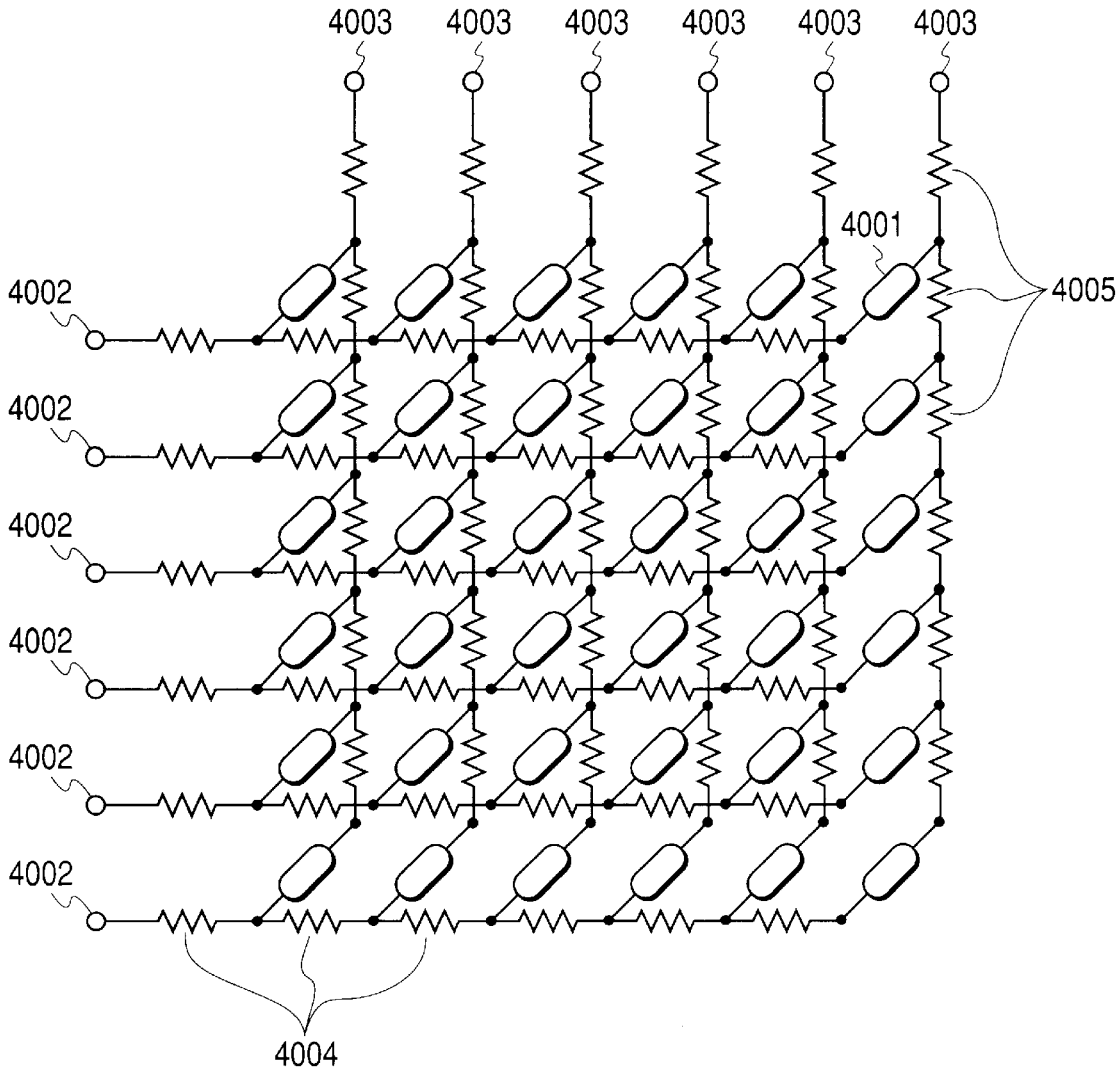
FIG. 17 is a view to describe matrix wiring of a prior art multi electron source.

FIGS. 14A to 14C are examples at the time when filter curve calculation for one dimension in the line was executed, and offset setting subsequent to the calculation method on the filter curve for one dimension in lines will be described.

In FIGS. 14A to 14C, the calculation on offset setting has been executed based on the calculation value of Ie of the surface conduction type emitting device in one line in Embodiment 2.

At first, after the direction of the filter on lines or columns has been determined, for Ie measurement distribution of each surface conduction type emitting device in one line, calculation of approximated curve by way of polynominal approximation method as in the curve A shown in FIG. 14A for example (the curve equation in the example is approximation up to second order and will become $y=-3\times10^{-6}x^2+0.0023x+0.5988$) is executed so that the low frequency space distribution information within lines is extracted.

The approximation curve calculated here is caused to give an offset value to the curve A utilizing the condition of "individual target setting value≦the average value of the measurement value of each device" in the direction of the average value line (the straight line B) of the measurement value shown in FIG. 14B toward the curve A (by offsetting so that while maintaining the shape of the curve A, none of the points on the curve after movement will rise over the straight line B) so as to give rise to the curve C shown in FIG. 14C. The target setting value for each electron emission device is determined corresponding with the position for each device on this curve C and is written into the target value memory 309*f* in FIG. 4. In addition, the measurement result of the Ie of each surface conduction type emitting device is compared with the target value of each surface conduction type emitting device so that the target shift quantity on all the surface conduction type emitting device is determined.

In the present embodiment, as described above, the characteristics shift pulse application time is changed so that characteristics adjustment is executed. Therefore, the date showing how much the characteristics curve shifts with how much characteristics shift pulse time being applied to the surface conduction type emitting device having a certain initial characteristics (the data represented by the graph shown in FIG. 12) is stored in the look-up table 309*d*.

In addition, the shift pulse application time necessary for shift each device to the target value 309*f* is stored in the memory 309*c*. Since the flow of characteristics adjustment is the same as in Embodiment 2, description thereon will be omitted.

The present embodiment involves Vdrv=14 v, Vpre=16 v and the rectangular pulse with the pulse width 1 ms and the period 3 ms. Incidentally, the present embodiment gives right to an effect that the processing time can be shortened further compared with Embodiment 1 and Embodiment 2 since it does not give shift adjustment signal to the surface conduction type emitting device having characteristics of not more than the target setting amount.

In each of the above described embodiment, the emission current is measured as the electron emission characteristics, and based thereon the target value of characteristics adjustment was set. The object for measurement is not limited to the construction directly measuring the emission current, but luminance of light emission with electron irradiation from each device may be measured as described in Embodiment 1 and luminance corresponding with a predetermined application signal (application voltage) may be treated as electron emission characteristics. In the following embodiment, a suitable example in which light-emission luminance is measured and based on that measurement result the electron emission characteristics are changed will be shown.

[Embodiment 4]

In this embodiment, n and m in Embodiment 1 were set at m=3840 and n=768 respectively.

Figure 18:
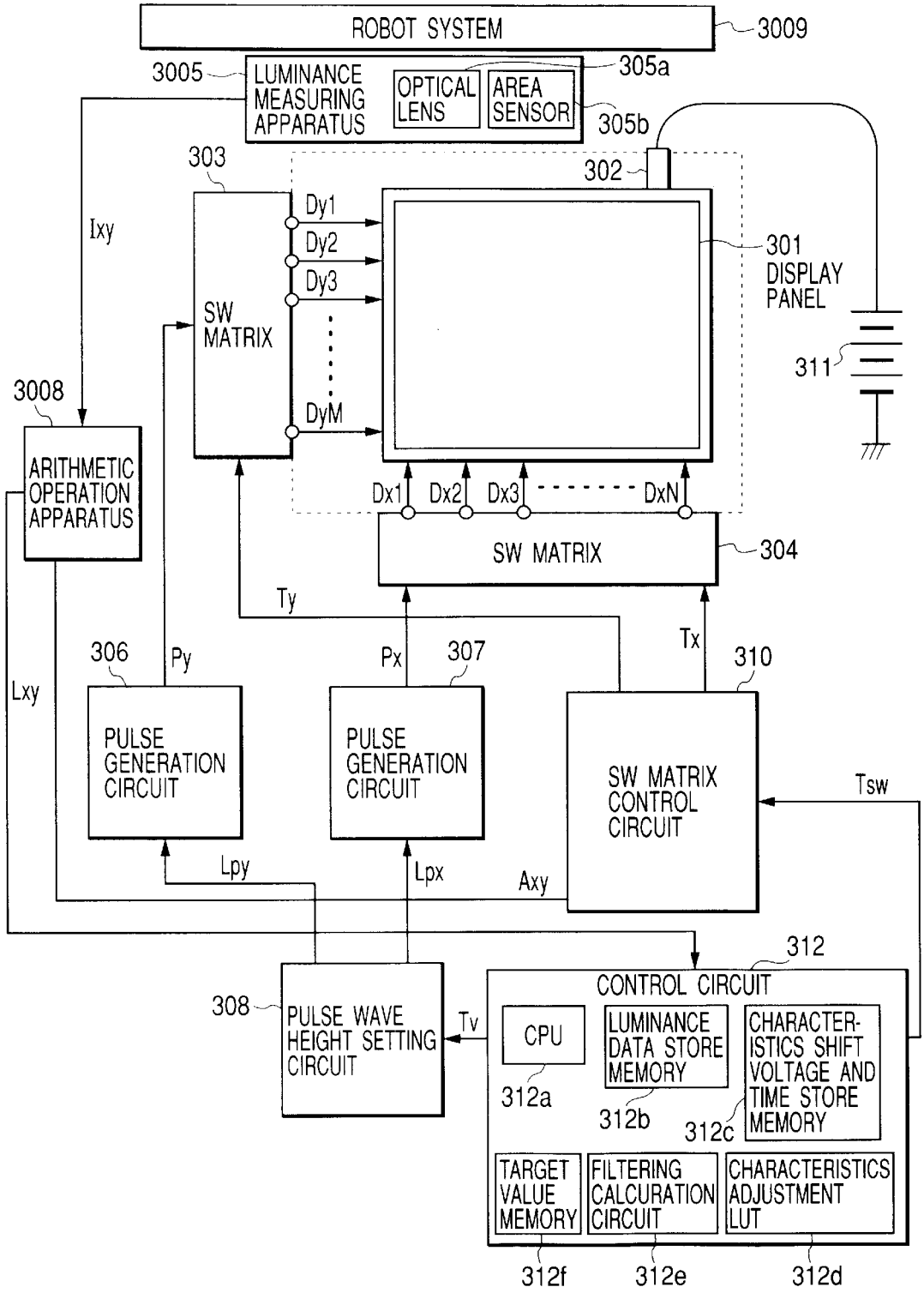
FIG. 18 is a schematic view of a device being an embodiment of the present invention to apply characteristics adjustment signals to an image forming device which has comprised a multi electron source.

FIG. 18 is a block diagram showing construction of a drive circuit for changing electron emitting characteristics of the respective surface conduction type emitting devices of the electron source substrate by applying wave signals for characteristics adjustment to each surface conduction type emitting device of the display panel 301.

The luminance measuring apparatus 3005 is a luminance measuring system to execute photoelectric sensing by capturing luminance of an image forming apparatus, and comprises an optical lens 305*a* and an area sensor 305*b* constructed by CCD etc. The luminance measuring apparatus 3005 electronizes the appearance of the image forming apparatus as two dimensional image information with such an optical system.

The arithmetic operation apparatus 3008 calculates information on luminance quantity corresponding with the surface conduction type emitting device one by one driven by inputting two-dimensional image information Ixy being an output of the area sensor 305*b* and the address information Axy indicating which device has been caused to be put on from the switch matrix control circuit 310 so as to be outputted to the control circuit 312 as Lxy. Details of this method will be described later.

The robot system 3009, which is for bringing the area sensor 305*b* into relative movement toward the display panel 301, is constructed by not shown ball screws and a linear guide.

The pulse wave height value setting circuit 308 outputs the pulse setting signals Lpx and Lpy to determine the wave height values of the pulse signals outputted respectively from the pulse generation circuits 306 and 307. The control circuit 312 controls the entire characteristics adjustment flow and outputs the data Tv for setting the wave height value onto the pulse wave height value setting circuit 308.

Incidentally, the control circuit 312 is constructed by CPU 312*a*, the luminance data store memory 312*b*, the characteristics shift voltage and time store memory 312*c*, the characteristics adjustment look-up table (LUT) 312*d*, the filtering calculation circuit 312*e* and the target value memory 312*f*.

The CPU 312*a* controls operations of the control circuit 312. The luminance data store memory 312*b* is a memory for storing luminance characteristics of each device for characteristics adjustment on each device. In particular, the luminance data store memory 312*b* normally stores luminance data in proportion (including one time) with light-emission luminance illuminated with electrons emitted from each device at the time of application of the drive voltage Vdrv. The characteristics shift voltage and time store memory 312*c* is a memory to store the characteristics shift voltage necessary for being set at the tart setting value. The characteristics adjustment look-up table 312*d*, details of which will be described later, is a table for reference to implement characteristics adjustment of devices.

The switch matrix control circuit 310 outputs switch switching signals Tx and Ty to control selection of switches of the switch matrix 303 and 304 and thereby selects electron emission device to which the pulse voltages are applied. In addition, the switch matrix control circuit 310 outputs to the arithmetic operation apparatus 3008 the address information Axy indicating which device has been caused to be put on.

Next, operation of this drive circuit will be described. Operation of this drive circuit is constructed by a stage to measure light-emission luminance of each surface conduction type emitting device of the display panel 301 so as to obtain the luminance dispersion information necessary for reaching the adjustment target value and a stage to apply a pulse wave signal for characteristics shift so as to reach the adjustment target value.

At first, a method to measure the light-emission luminance will be described. At first, with the robot system 3009, the luminance measuring apparatus 3005 of an optical system is moved so as to be caused to be disposed on the opposite side on the display panel 301 measurement of which is desired. Next, the switch matrix control circuit 310 outputs the control signal from the control circuit 312 with the switch matrix control signal Tsw, and with the said control signal the switch matrix 303 and 304 select the predetermined wiring in the line direction or wring in the column direction for supplying the selected wiring with the pulse signal corresponding with the signal from the pulse wave height value setting circuit 308. Thereby the surface conduction type emitting device of the desired address is driven.

The control circuit 312 outputs the wave height value data Tv for measuring the electron emission characteristics to the pulse wave height value setting circuit 308. This causes the pulse wave height value setting circuit 308 to output the wave height value data LPx as well as Lpy to the pulse generation circuits 306 and 307 respectively. Based on this wave height value data Lpx as well as Lpy, the pulse generation circuit devices 306 as well as 307 respectively output the drive pulse Px as well as Py and this drive pulse Px as well as Py is applied to the device selected by the switch matrix 303 as well as 304. Here, this drive pulse Px as well as Py is set in the surface conduction type emitting device to form a pulse having a half amplitude of the voltage (wave height value) Vdrv applied for characteristics measurement and polarity different from each other. In addition, at the same time, a predetermined voltage is applied to the fluorescent member of the display panel 301 with the high voltage power supply 311.

This step of address selection and pulse application is repeated over a plurality of line wiring and the rectangular region of the display panel undergoes scanning for driving.

Figure 19:
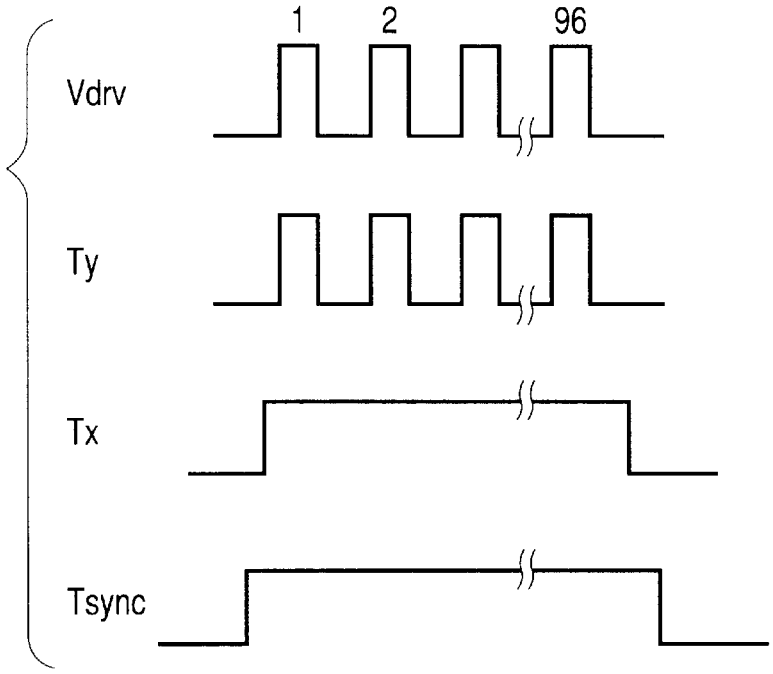
FIG. 19 is a driving timing chart in an embodiment of the present invention.
Figure 20:
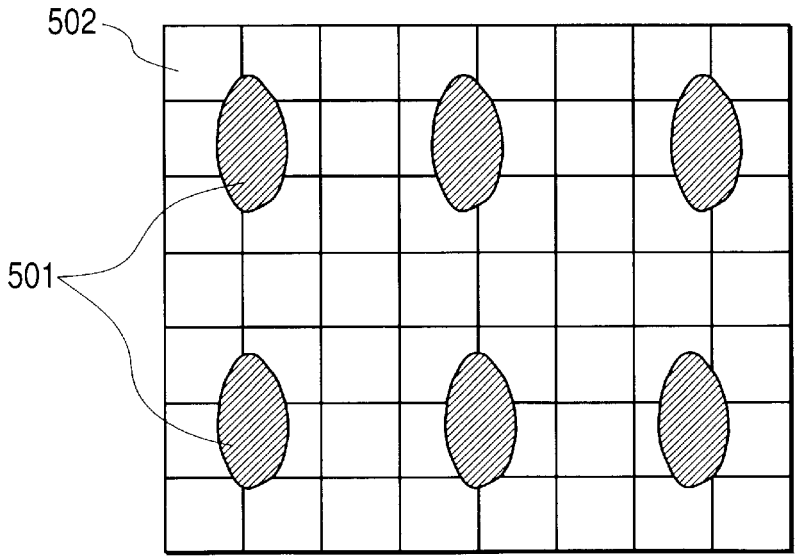
FIG. 20 is a model view to show a look how the luminance point on the image forming device in an embodiment of the present invention has been projected onto an area sensor.

The signal Tsync indicating the period of the step of this repetition is transferred to the area sensor 305*b* as the trigger of the electron shutter. That is, the control circuit 312 sequentially outputs the drive signal in synchronization with tx and Ty as shown in FIG. 19 for the portion covering the number of line wiring scanning Ty. Tsync signal is outputted so as to contain those units of Ty signal. The shutter of the area sensor 305*b* is opened for the period of the Tsync being in a high level, that is, logically being active, and therefore reduced lighted image is created on the area sensor 305*b* via the optical lens 305*a* only for that period. That appearance is schematically shown in FIG. 20. The reducing rate of the optical system should be set to cause the image corresponding with one illuminating point 501 to be created onto the devices 502 of a plurality of area sensors.

This imaged image is transferred to the arithmetic operation apparatus 3008 as the two-dimensional image information Ixy. The images of the driven devices are created, and therefore calculation of the sum covering those allocated devices will constitute a luminance value in proportion with the luminance quantity of those driven devices. This makes available the luminance value corresponding with the devices of the driven rectangular area, the information is sent to the control circuit 312 as Lxy.

In the present embodiment, light-emission luminance characteristics are measured, and corresponding therewith the characteristics are changed, and therefore the luminance characteristics of each display device can be said to be changed. However, the present embodiment involves the electron emission device as the display device, and changes in the luminance characteristics will be equivalent to the changes in the electron emission characteristics. Since the light-emission luminance corresponds basically with the electron emission quantity Ie approximately on the one-by-one ratio with other requirements (acceleration voltage, luminance efficiency of fluorescent member and current density) being constant, the characteristics adjustment in the present embodiment may be executed as in Embodiment 1 to 3. Incidentally, the luminance quantity for the emission current is determined by acceleration voltage of electrons, the luminance efficiency of the fluorescent member and the current density characteristics, and therefore adding them in advance, the shift voltage is applied so that the luminance characteristics can be shifted. Also in the present embodiment, such characteristics adjustment was executed.

Relationship between the electron emission quantity from the electron emission device and the light-emission luminance is determined by the acceleration voltage of electrons, the current density and the luminance characteristics of the fluorescent member. Therefore, in order to know how much the characteristics curve shifts rightward with application of how many voltages for characteristics shifting for how long toward the electron emission device having a certain characteristics (initial characteristics), the electron emission devices having various characteristics should be selected and various amounts of Vshift were applied thereto for experiments to calculate luminance so that various data should be stocked. Incidentally, in the apparatus in FIG. 18, these data are stocked in advance in the control circuit 312 as a characteristics adjustment look-up table 312*d*.

Figure 21:
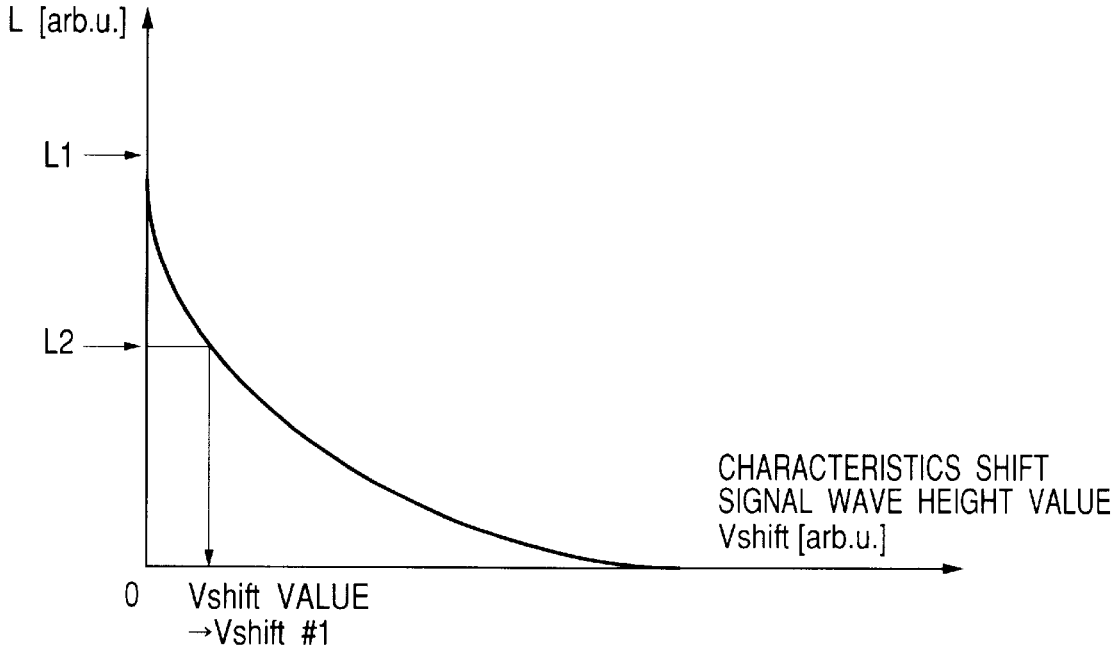
FIG. 21 is a view having shown characteristics shift pulse voltage wave height value and emission current changes.

FIG. 21 shows as a graph with data of the electron emission device having a certain initial characteristics being picked up from the characteristics adjustment look-up table 312*d*. The horizontal axis of this graph expresses the amount of the application voltage of the characteristics shift voltage and the vertical axis expresses the light-emission luminance L. This graph is a result (the vertical axis) in which the emission current was measured when the drive voltage of the same amount as Vdrv was applied after the characteristics shift voltage (the horizontal axis) was applied. Accordingly, in order to determine for the device having the characteristics having illuminated with L1 at the time of application of Vdrv the amount of the characteristics shift voltage to be applied so as to provide L2 at the time of application of Vdrv, the only thing to do is to read the Vshift value in such a point that the L is equal to L2 in the graph in FIG. 21. (Vshift#1 in FIG. 21)

Incidentally, in the present embodiment, characteristics adjustment is executed with respect to each small region by dividing the region of the display panel into 10 sections horizontally and into 8 sections vertically. The number of devices each small region is 384 units in the horizontal direction and 96 units in the vertical direction.

As described below, in the present embodiment, convolution arithmetic operation is executed so that the measurement results undergo smoothing processing. At this time, in the fringe part of each small region, with the measurement results of the adjacent small regions, convolution arithmetic operation is executed so that discontinuity of device characteristics in the border part of each small region is controlled. In order to make this possible, the luminance measuring apparatus 3005 is constructed so as to be able to measure the device characteristics of the parts necessary for convolution arithmetic operation in one small region and in the periphery thereof with the relative positions of the luminance measuring apparatus and the display panel being fixed.

In the present embodiment, since a fluorescent member of one color of one pixel was constructed to have size of 205

μm×300 μm and the black stripe width of 300 μm, the display region of 3840×768 pixels will become approximately 790 mm×460 mm. Accordingly, the robot system was designed so that the region underwent scanning, and the magnifying ratio of the optical system was set at 0.18 time.

Incidentally, here the characteristics of devices are not adjusted after measurement of all visions are executed, but the step to adjust the characteristics of devices of small regions that the vision covers starts immediately after the step to measure the characteristics of the devices of a certain vision (a vision refers to a range that luminance measurement can be executed with the relative positions of the luminance measuring apparatus and the display panel being fixed).

Figure 22:
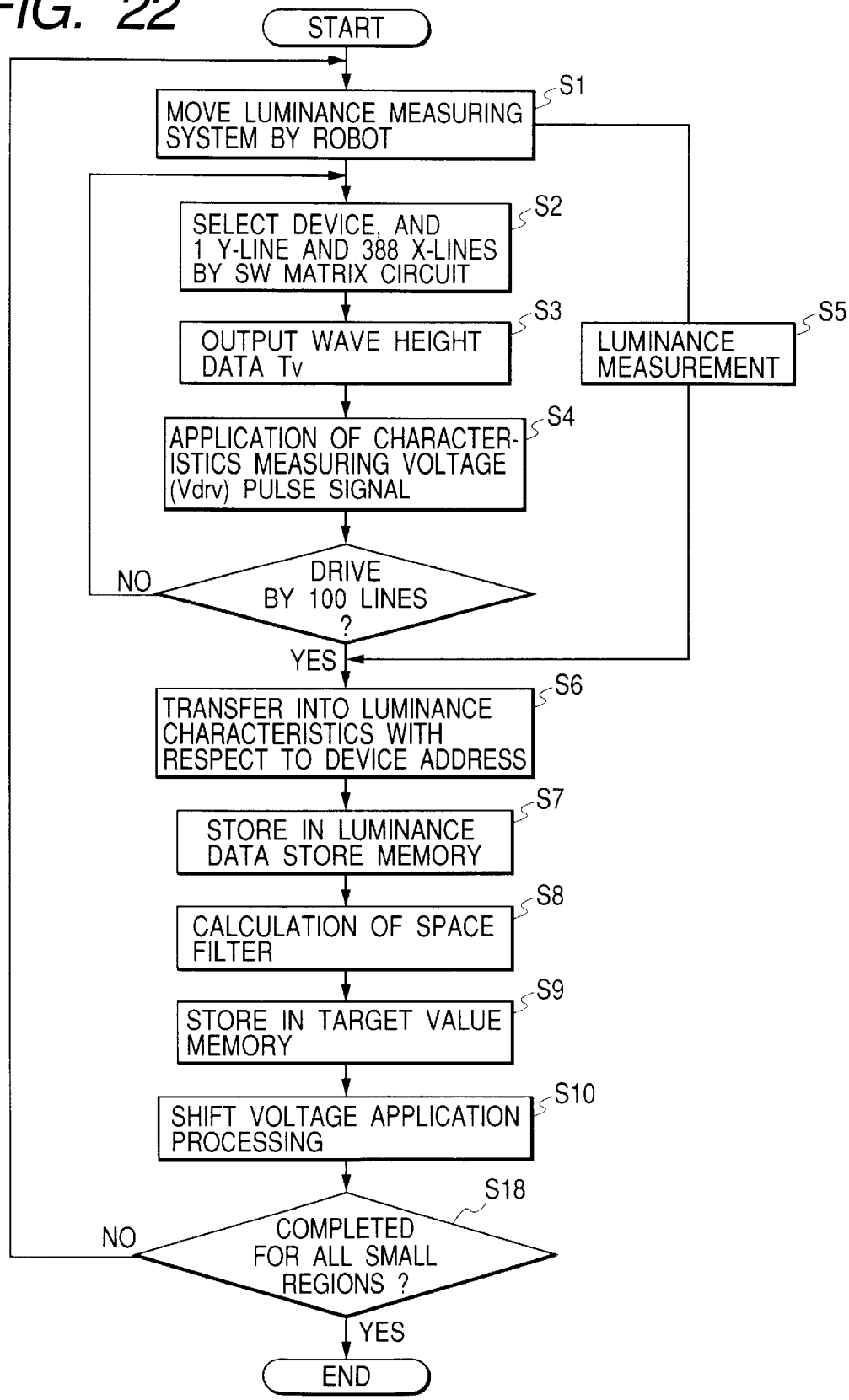
FIG. 22 is a flow chart showing the processing to measure luminance characteristics of each surface conduction type electron-emitting device of the electron source of the present embodiment.

FIG. 22 is a flow chart showing the characteristics measuring processing by the control circuit 312.

At first, in Step S1, the optical system is moved to a desired vision. Here, the case involving measurement of the vision in the upper left corner in the display panel will be exemplified. Next, in Step S2, the switch matrix control signal Tsw is outputted so that the switch matrix 303 and 304 are switched with the switch matrix control circuit 310 to select 384+4 devices of the surface conduction type emitting device of the display panel 301 (this consists of the number of the device connected to the wiring in one line direction (Y direction) among 96×384 units of devices contained in one small region to which four devices in the left end in the adjacent small region in the right neighbor). Next, in Step S3, the wave height value data Tv of the pulse signals applied to that selected device is outputted to the pulse wave height setting circuit 308. The wave height value of the pulse for measuring is set so as to become equivalent to the drive voltage Vdrv at the time when the application voltage to the device executes image display.

In addition, in Step S4, with the pulse generation circuits 306 and 307 via the switch matrix 303 and 304, the pulse signals for characteristics measurement of the electron emission device are applied to 388 units of the surface conduction type emitting device selected in Step S1. From this Step 2 to Step 4 repeated 96+4 times (including the portions covering 96 lines in the small region in the upper left corner of the display panel and 4 lines in the upper end of the small region adjacent to the bottom of this small region) while designated line wiring is sequentially changed. At the same time as those Steps, in Step S5, the luminance image of the driven region is measured. That is, Step 2 to Step 4 are executed once and together with Step 5 being executed, the light-emission luminance of 388 devices is measured at the same time, and this is repeated for 100 lines. Next, Step S6 executes conversion into luminance values corresponding with the device address from the luminance image and the address of the driven device. That is, 388×100 units of devices are driven and its luminance value became obtainable. Step S7 executes storage into the luminance data store memory 312*b*.

Next, the step goes forward to Step S8 to execute the space filter processing in the filtering calculation circuit 312*e* from the light emission luminance distribution on 388×100 units of the surface conduction type emitting device (all devices included in one vision) of the display panel 301.

Here, an example of filter curve calculation in two-dimensional space (plane) will be described. In this embodiment, after the display characteristics (luminance for the application signal and the electron emission quantity for the application signal) of each device were measured, smoothing processing was applied to the measurement data and thereby the target value is set with those having less high frequency components. Here, in particular, convolution arithmetic operation is executed to reduce the high frequency components. Smoothing involving convolution arithmetic operation is well known as a technique of data analysis or a technique of image processing. Here, smoothing is executed by obtaining on the data of each device the sum of the matrix constructed by the data of each device and the data of the device adjacent thereto multiplied by a particular matrix. In the present embodiment, the two-dimensional luminance data undergo at first smoothing processing by executing convolution with the value generally known as the two-dimensional convolution kernel of Savitzy-Golay of 7×7 factors shown in FIG. 23. Offsetting is added to such obtained low frequency spatial distribution image of luminance based on the condition of the individual target setting value of each device<the measurement values of each device to be treated as the individual target setting value of each device. This is for executing characteristics adjustment in such a direction that luminance is reduced as described above.

Figure 24:
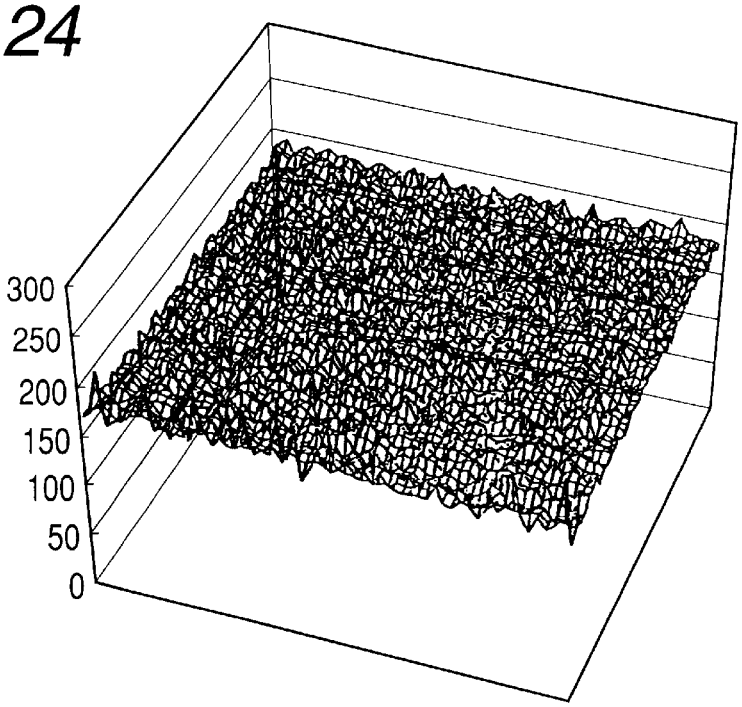
FIG. 24 is a data example prior to the space filter processing in an embodiment of the present invention.
Figure 25:
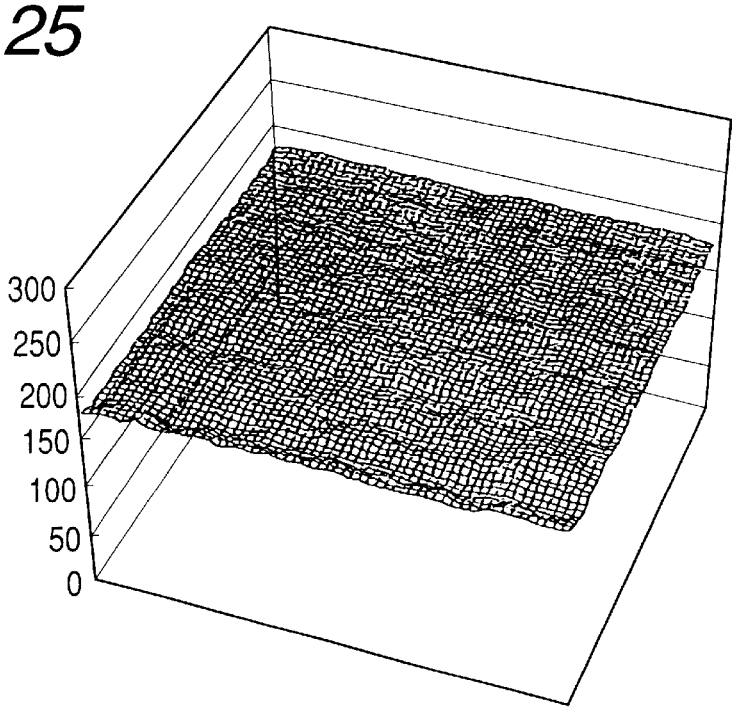
FIG. 25 is a data example after the space filtering processing in an embodiment of the present invention.

And this individual target setting value is stored in the target value memory 312*f*. Data before and after that smoothing processing are shown in FIG. 24 and FIG. 25. It is obvious that minute dispersion distribution is reduced in FIG. 25 showing the data after filter processing compared with in FIG. 24 being the data before filter processing. The XY axes in FIG. 24 and FIG. 25 are pixel directions and the Z axis expresses the relative luminance value.

In the case of providing with a plurality of small regions as in the present embodiment to execute measurement and execute characteristics adjustment, the characteristics treated as the target could become discontinued in the boundary between the small regions. This discontinuity in characteristics gives rise to linear luminance difference in the boundary of small regions, which is visually recognizable as lines, and therefore it is recommendable that the target value in the vicinity of the boundaries is made continuous. In the present embodiment, the target values are set as described below so that the target values in the vicinity of the boundaries are prevented from getting discontinued.

At first, measurement vision is overlapped a little by a little on each vision for measurement. Here in the present embodiment, measurement is executed so that 4 pixels (this is a pixel of not less than half the width of the convolution kernel (matrix for convolution arithmetic operation) being adjacent in the small regions outside the said small regions can be utilized. This enables convolution arithmetic operation to be executed with the data of pixels positioned in the end of the adjacent small regions. For example, in the case where the convolution arithmetic operation on the small region (the second small region) adjacent right to the region covered by the vision described in detail on the measurement method above (the small region in the upper left corner of the display panel: this is referred to as the first small region. It includes up to $384^{th}$ pixels counted rightward from the pixel disposed in the upper left corner of the display panel.) is executed, the data of 380th to 388th pixels counted from the pixel at the left end of the display panel are already measured in advance, and therefore, those data are used as are, and in addition thereto, the data of 384 units starting $389^{th}$ pixel obtained in the measurement in the vision covering the second small region are newly used. The point that measurement is executed on 100 lines in the vertical direction is the same as the measurement in the first small region. In order to obtain the convolution results corresponding with the measurement data of the second small region, the data of pixels (pixels adjacent to the second small region among the pixels in the above described respective small regions) belonging to other small regions adjacent to each line and corner of the second region (the first small region being the left adjacent small region, the right adjacent small region, the bottom adjacent small region and the small regions adjacent left and right respectively to the said bottom adjacent small region since the second small region does not have the upper adjacent small region) are used to execute convolution arithmetic operation, and at this time, the data of the pixel measured when the vision including the first small region was measured are used as they are. The characteristics adjustment on the first small region is over with execution of the step described below, and the data measured after conclusion of the characteristics adjustment of the pixel subject to characteristics adjustment are not used, but the data having been acquired in advance are used for convolution arithmetic operation, and therefore discontinuity of characteristics in the boundary between the small regions can be controlled.

In addition, the above described offset quantity was determined to be specified by the first small region. Giving offset with that offset quantity for the other small regions, the boundary portions between the small regions can undergo characteristics adjustment without giving rise to gaps.

Figure 26:
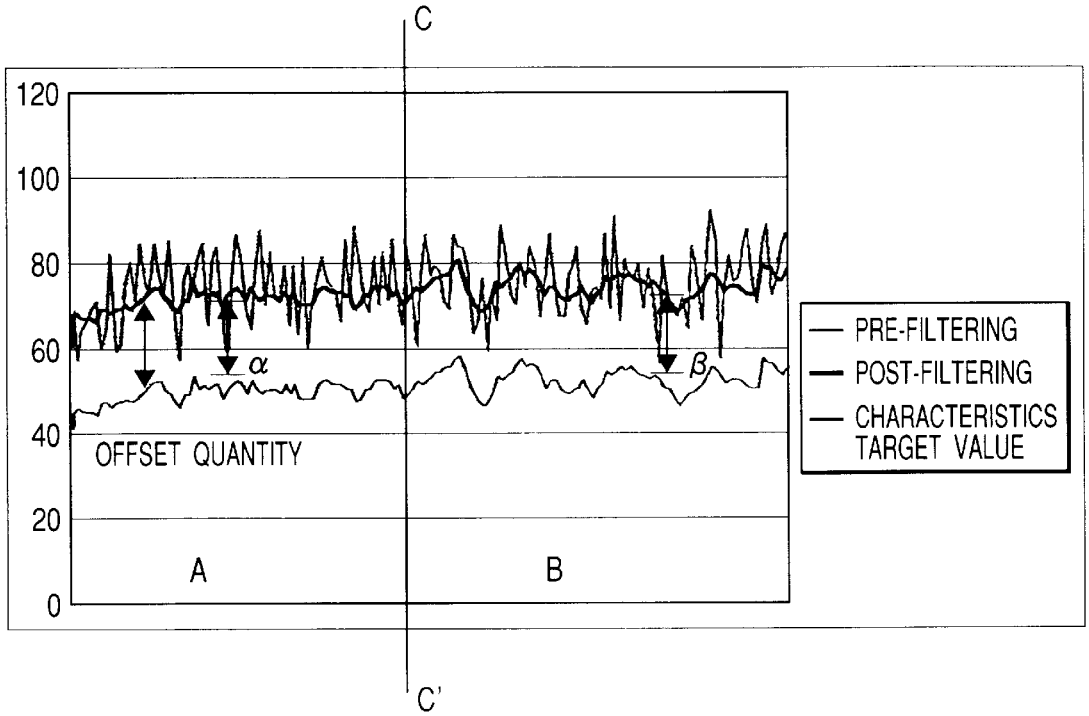
FIG. 26 is a view having shown in a modelized fashion the data and characteristic target value before and after the filter processing.

Here, for simplicity, one-dimensional data will be used for description. FIG. 26 schematically shows the data before and after filter processing and the characteristics target values. The portion being the boundary between the small regions is indicated with the complementary line C–C'. For convenience, reference character A is made to denote the left side of the complementary line and B to denote the right side thereof in FIG. 26, and then when the small region A is measured, the characteristics data of the device disposed in the portion (overlapping region) adjacent to the small region A in the small region B are measured together. Based on that measurement results, the small region A undergoes filtering processing. Here, the filtering processing of the small region A is executed with measurement data of the above described overlapping region, but the filtering processing value corresponding with the device disposed in the above described overlapping region is not given. Next, the small region B is measured and filtering processing on the small region B is executed. The measurement data of the small region A necessary at the time of filtering processing of the small region B involves the data measured at the time of measurement of the above described small region A. The filter processing value of the device disposed in the above described overlapping region will be given here.

In the stage when the filter processing in the small region A is over, the offset quantity is determined, and the balance between the value after filter processing in the small region A and the minimum value ($\alpha$ in the drawing) is not always the same as the balance between the value after filter processing in the small region of all parties and the minimum value of each small region ($\beta$ being the value of the region B), and therefore here, the offset quantity was set at the value of six times the coefficient of the region A divided by the average value.

In addition, the portion of the small region disposed in the outskirt has the line lacking in the adjacent small region, and therefore convolution processing cannot be executed on four pixels, but for the target value of that portion, the value of the pixel disposed in the one inward was used. Thus, after determination of the characteristics target value on each vision, shift voltage application processing is executed in Step S10.

Over here, the shift voltage application processing on one small region is concluded.

In Step S18, on all small regions of the display panel, it is checked whether or not the luminance measurement and the shift voltage application processing were executed, and otherwise, the step goes forward to Step S1, the luminance measuring apparatus 3005 being the optical system is moved to the next vision for repetition.

In the present embodiment, the robot system 3009 was used for the movement of the luminance measuring apparatus 3005, and the movement speed of this luminance measuring apparatus 3005 was 30 mm/second. One vision is approximately 80 mm×60 mm and therefore the movement time between visions was approximately 4 seconds.

The present embodiment involves Vdrv=14 v, Vpre=16 v and Vshift=16 to 18 v and the rectangular pulse with the pulse width 1 ms and the period 2 ms for the characteristics shift and the pulse width 18 $\mu$s and the period of 20 $\mu$s for the luminance measurement.

Figure 27:
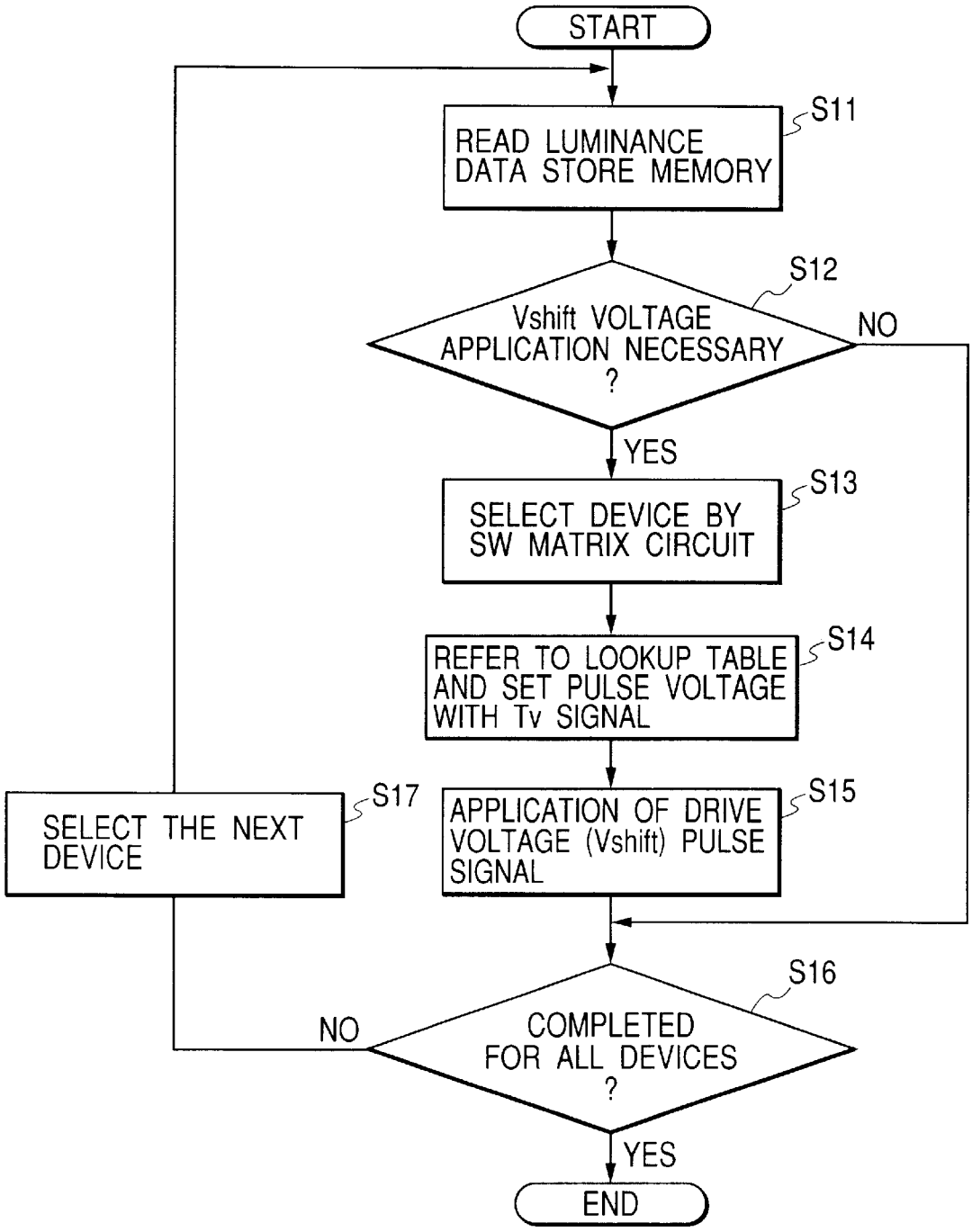
FIG. 27 is a flow chart to show processing to apply characteristics adjustment signals based on the measured electron emitting characteristic.

FIG. 27 is a flow chart showing processing, which is executed with the control circuit 312 of the present embodiment, to make uniform the luminance value of the surface conduction type emitting device inside one small region of the display panel 301 with the target setting value and is equivalent to Step S10 in FIG. 22.

At first, in Step S11, the luminance value measured by the memory 312*b* is read. And, in Step S12, whether or not application of the characteristics shift voltage is necessary for that surface conduction type emitting device, that is, the state of more or less than the luminance value being the target is judged. If the shift voltage application is necessary, as Step S14, the data of the device having the initial characteristics most approximate to the said device among the characteristics adjustment look-up table 312*d* are read out. In addition, the characteristics shift voltage application time to equalize the characteristics of that device with the target value is selected from the said data.

At first, in Step S13, the switch matrix 303 as well as 304 is controlled with the switch matrix control signal Tsw via the switch matrix control circuit 310 so that one device of the surface conduction type emitting device of the display panel 301 is selected. In addition, the wave height value of the pulse signal is set by the wave height value setting signal Tv with the pulse wave height value setting circuit 311, and in Step S14, the pulse wave height value setting circuit 8 outputs the wave height value data Lpx as well as Lpy and based on that value the pulse generation circuit 306 as well as 307 outputs the drive pulses Px as well as Py with the pulse width of that set wave height value.

Thus, the value of the voltage for characteristics shift is determined, and to the surface conduction type emitting device that requires shift of characteristics the characteristics shift pulse corresponding with those characteristics is applied.

Step S16 checks whether or not processing on all surface conduction type emitting device inside one small region is over, and if not, the step returns to Step S11.

The image forming apparatus produced with the above described steps was driven with Vdrv=14V to measure the luminance unevenness of entire surface, coefficient/average value was 3%. In addition, an image with high quality without giving rise to a sense of dispersion could be displayed when the moving image was displayed on that panel.

The present embodiment involved the two-dimensional convolution kernel of Savitzy-Golay for filter processing to execute smoothing, but any method that can produce flat data from local data can be used. For example, cubicBspline function, hunning filter, humming filter, and Blackman filter and the like can be used.

In addition, in the present embodiment, measurement was executed on each vision, and the characteristics of the small region measured prior to measurement of the next vision were changed, but in case of measuring each vision respectively as well, all pixels constructing the display panel may be measured once so that thereafter the step of the characteristics change is executed.

So far, the construction using the electron emission device, in particular, the construction using the surface conduction type emitting device the surface conduction type emitting device was described, but without limiting to the surface conduction type emitting device, the present applied invention can be applied to various electron emission devices. For example the present applied invention can be suitably applied to the construction that the electron emission characteristics are adjusted by changing the shape of the emitter corn or the gate electrode with electric field evaporation by application of voltage between the emitter corn and gate electrode of the electrode emission device of a spint type. Incidentally, in the case where the invention related to the present application is applied to an electron source or an image display apparatus using electron emission device, the construction that the emitter (electron emission part) has carbon or carbon compounds as electron emission device can be suitable adopted. The emitter having carbon or carbon compounds (for example graphite or amorphous carbon or mixture thereof, etc.) can realize an electron emission device with high electron emission efficiency. In particular, in the case where the emitter has carbon or carbon compound, there is also an advantage that the characteristics can be easily changed with voltage application.

In addition, as shown in Japanese Patent Application Laid-Open No. 63-289794 for example, also it is known that in electro-luminescence devices, characteristics are changed with voltages applied to the device at the time of manufacturing or heat. Utilizing this to employ the construction to change the characteristics of the electro-luminescence devices, the present applied invention may be applied thereto.

In addition, in the above described embodiments, the step of characteristics change was present to be executed once, but after the step of characteristics change is executed on each device once, followed by characteristics measurement again, the step of characteristics change may be executed again based on that measurement results. The said repeated characteristics measurement is to measure characteristics of the device subject to the step of the first characteristics change, but in the sense that the characteristics of the device prior to completion of the step of the repeated characteristics change are measured, it will become a step of the characteristics measurement of the device prior to completion of the step of the characteristics change.

What is claimed is:

1. A method of adjusting a characteristic of an electron source having a plurality of electron emitting devices arranged on a substrate, the method comprising:

a characteristic changing step of changing electron emission characteristics of the electron emitting devices, and wherein in the characteristic changing step, target values indicative of targets for changes in electron emission characteristic are such that a spatial distribution of the target values has spatial frequencies obtained by removing predetermined high-frequency components from spatial frequencies of a spatial distribution of the electron emission characteristics of the plurality of electron emitting devices obtained before the characteristic changing step or reducing predetermined high-frequency components of the spatial distribution, and in said characteristic changing step, the electron emission characteristics are changed so as to approach the respective target values.

2. The method of adjusting a characteristic of an electron source according to claim 1, wherein said target values are obtained by subjecting the spatial distribution of the electron emission characteristics of said plurality of electron emitting devices obtained before said character changing step to Fourier transform, removing predetermined high-frequency components from the Fourier transform results, and subjecting the high-frequency component removed results to inverse Fourier transform.

3. A method of adjusting a characteristic of an electron source having a plurality of electron emitting devices arranged on a substrate, the method comprising:

a characteristic changing step of changing electron emission characteristics of the electron emitting devices, and wherein in the character changing step, target values indicative of targets for changes in electron emission characteristics have a non-uniform spatial distribution, and the spatial distribution of the target values is obtained by an step of reducing predetermined high-frequency components of spatial frequencies of a spatial distribution of the electron emission characteristics of the plurality of electron emission characteristics obtained before the character changing step, and in the character changing step, the electron emission characteristics are changed so as to approach the respective target values.

4. The method of adjusting a characteristic of an electron source according to claim 1 or 3, wherein said target values are obtained by subjecting the spatial distribution of the electron emission characteristics of the plurality of electron emitting devices obtained before said character changing step, to polynominal approximation to obtain an equation of predetermined orders equal to or larger than the first order which represents the spatial distribution of the target values.

5. A method of adjusting a characteristic of an electron source having a plurality of electron emitting devices arranged on a substrate, the method comprising:

a characteristic changing step of changing electron emission characteristics of the electron emitting devices, and wherein in the character changing step, target values indicative of targets for changes in electron emission characteristics have a non-uniform spatial distribution, and the spatial distribution of the target values is obtained by an step of smoothing a spatial distribution of the electron emission characteristics of the plurality of electron emission characteristics obtained before the character changing step, and in said character changing step, the electron emission characteristics are changed so as to approach the respective target values.

6. The method of adjusting a characteristic of an electron source according to any of claims 1 to 5, wherein the operation of changing said electron emission characteristics in said character changing step changes the amount of electrons emitted when a predetermined voltage is applied to each of said electron emitting devices.

7. The method of adjusting a characteristic of an electron source according to claim 1 or 5, wherein said target values are obtained by smoothing the spatial distribution of the electron emission characteristics of the plurality of electron emitting devices obtained before the character changing step.

8. The method of adjusting a characteristic of an electron source according to claim 7, wherein said smoothing is achieved by a convolution operation.

9. The method of adjusting a characteristic of an electron source according to any of claims 1 to 5, further comprising a step of determining the target values, the target value determining step having a high-frequency component reducing step of removing predetermined high-frequency components from the spatial distribution of the electron emission characteristics of the plurality of electron emitting devices obtained before the character changing step or reducing predetermined high-frequency components of the spatial distribution, and a step of offsetting the spatial distribution obtained in the high-frequency component reducing step while maintaining the shape of the spatial distribution.

10. The method of adjusting a characteristic of an electron source according to any of claims 1 to 5, wherein said characteristics are changed by applying a voltage to the electron emitting devices.

11. The method of adjusting a characteristic of an electron source according to any of claims 1 to 5, further comprising a step of measuring the electron emission characteristics of the plurality of electron emitting devices before said characteristic changing step.

12. The method of adjusting a characteristic of an electron source according to any of claims 1 to 5, wherein a measuring step of measuring said electron emission characteristics, a target value determining step of determining said target values, and a step of changing said electron emission characteristics are executed for each group of electron emitting devices in said plurality of electron emitting devices.

13. The method of adjusting a characteristic of an electron source according to any of claims 1 to 5, further comprising a measuring step of measuring the electron emission characteristics of some of said plurality of electron emitting devices, a target value determining step of determining said target values for some of the plurality of electron emitting devices which have the electron emission characteristics measured in the measuring step, and a step of changing said electron emission characteristics of some of the plurality of electron emitting devices which have the electron emission characteristics measured in the measuring step.

14. The method of adjusting a characteristic of an electron source according to claim 13, further comprising a further measuring step of measuring the electron emission characteristics of the plurality of electron emitting devices other than those which have the electron emission characteristics measured in said measuring step, and a further changing step of changing the electron emission characteristics of the electron emitting devices that have the electron emission characteristics measured in the further measuring step, wherein in the further changing step, target values indicative of targets for changes in electron emission characteristics are determined on the basis of results of measurements in said further measuring step and results of measurements in said measuring step.

15. The method of adjusting a characteristic of an electron source according to any of claims 1 to 5, wherein the electron emission characteristics of said electron emitting devices are changed in an atmosphere in which the changed electron emission characteristics can be maintained.

16. The method of adjusting a characteristic of an electron source according to any of claims 1 to 5, wherein the electron emission characteristics of said electron emitting devices are changed in an atmosphere in which an organic gas undergoes a partial pressure of $1.0\times10^{-6}$ [Pa] or lower.

17. The method of adjusting a characteristic of an electron source according to any of claims 1 to 5, wherein said electron emitting devices each have an emitter composed of carbon or a carbon compound.

18. The method of adjusting a characteristic of an electron source according to any of claims 1 to 5, wherein said electron emitting devices are surface conduction type emitting devices.

19. A method of manufacturing an electron source having a plurality of electron emitting devices arranged thereon, the method comprising the steps of:

forming a plurality of electron emitting devices; and changing characteristics of said electron emitting devices using a method set forth in any of claims 1 to 5.

20. A method of adjusting a characteristic of an image display apparatus having a plurality of display devices, the method comprising:

a characteristic changing step of changing electron emission characteristics of the display devices, and wherein the characteristic changing step, target values indicative of targets for changes in display characteristic are such that a spatial distribution of the target values has spatial frequencies obtained by removing predetermined high-frequency components from spatial frequencies of a spatial distribution of the display characteristics of the plurality of display devices obtained before the characteristic changing step or reducing predetermined high-frequency components of the spatial distribution, and in said characteristic changing step, the display characteristics are changed so as to approach the respective target values.

21. The method of adjusting a characteristic of an image display apparatus according to claim 20, wherein said target values are obtained by subjecting the spatial distribution of the display characteristics of said plurality of display devices obtained before said character changing step to Fourier transform, removing predetermined high-frequency components from the Fourier transform results, and subjecting the high frequency component removed results to inverse Fourier transform.

22. A method of adjusting a characteristic of an image display apparatus having a plurality of display devices, the method comprising:

a characteristic changing step of changing display characteristics of the display devices, and wherein the character changing step, target values indicative of targets for changes in display characteristics have a non-uniform spatial distribution, and the spatial distribution is obtained by an step of reducing predetermined high-frequency components of spatial frequencies of a spatial distribution of the display characteristics of the plurality of display characteristics obtained before the character changing step, and in said character changing step, the display characteristics are changed so as to approach the respective target values.

23. The method of adjusting a characteristic of an image display apparatus according to claim 20 or 22, wherein said target values are obtained by subjecting the spatial distribution of the display characteristics of the plurality of display devices obtained before said character changing step, to polynominal approximation to obtain an equation of a predetermined order equal to or later than the first order which represents the spatial distribution of the target values.

24. A method of adjusting a characteristic of an image display apparatus having a plurality of display devices, the method comprising:

a characteristic changing step of changing display characteristics of the display devices, and wherein the character changing step, target values indicative of targets for changes in display characteristics have a non-uniform spatial distribution, and the spatial distribution of the target values is obtained by an step of smoothing the display characteristics of the plurality of display characteristics obtained before the character changing step, and in said character changing step, the display characteristics are changed so as to approach the respective target values.

25. The method of adjusting a characteristic of an electron source according to any of claims 20 to 24, wherein the operation of changing said display characteristics in said characteristic changing step changes a luminance obtained when a predetermined voltage is applied to each of said display devices.

26. The method of adjusting a characteristic of an image display apparatus according to claim 20 or 24, wherein said target values are obtained by smoothing the spatial distribution of the display characteristics of the plurality of display devices obtained before the character changing step.

27. The method of adjusting a characteristic of an image display apparatus according to claim 26, wherein said smoothing is achieved by a convolution operation.

28. The method of adjusting a characteristic of an image display apparatus according to any of claims 20 to 24, further comprising a step of determining the target values, the target value determining step having a high-frequency component reducing step of removing predetermined high-frequency components from the spatial distribution of the display characteristics of the plurality of display devices obtained before the character changing step or reducing predetermined high-frequency components of the spatial distribution, and a step of offsetting the spatial distribution obtained in the high-frequency component reducing step while maintaining the shape of the spatial distribution.

29. The method of adjusting a characteristic of an image display apparatus according to any of claims 20 to 24, wherein said characteristics are changed by applying a voltage to the display devices.

30. The method of adjusting a characteristic of an image display apparatus according to any of claims 20 to 22, further comprising a step of measuring the display characteristics of the plurality of display devices before said characteristic changing step.

31. The method of adjusting a characteristic of an image display apparatus according to any of claims 20 to 24, wherein a measuring step of measuring said display characteristics, a target value determining step of determining said target values, and a step of changing said display characteristics are executed for each group of display devices of said plurality of display devices.

32. The method of adjusting a characteristic of an image display apparatus according to any of claims 20 to 24, further comprising a measuring step of measuring the display characteristics of some of said plurality of display devices, a target value determining step of determining said target values for some of the plurality of display devices which have the display characteristics measured in the measuring step, and a step of changing said display characteristics of some of the plurality of display devices which have the display characteristics measured in the measuring step.

33. The method of adjusting a characteristic of an image display apparatus according to claim 32, further comprising a further measuring step of measuring the display characteristics of the plurality of display devices other than those which have the display characteristics measured in said measuring step, and a further changing step of changing the display characteristics of the display devices that have the display characteristics measured in the further measuring step, wherein in the further changing step, target values indicative of targets for changes in display characteristics are determined on the basis of results of measurements in said further measuring step and results of measurements in said measuring step.

34. The method of adjusting a characteristic of an image display apparatus according to any of claims 20 to 24, wherein the display characteristics of said display devices are changed in an atmosphere in which the changed display characteristics can be maintained.

35. The method of adjusting a characteristic of an image display apparatus according to any of claims 20 to 24, wherein the display characteristics of said display devices are luminance provided by the display devices when a predetermined signal is applied to the display devices.

36. The method of adjusting a characteristic of an image display apparatus according to any of claims 20 to 24, wherein said display devices comprise electron emitting devices.

37. The method of adjusting a characteristic of an image display apparatus according to any of claims 20 to 24, wherein said display devices are electroluminescence devices.

38. A method of manufacturing an image display apparatus having a plurality of electron emitting devices arranged thereon, the method comprising the steps of:

forming a plurality of display devices; and changing characteristics of said display devices using a method set forth in any of claims 20 to 24.

39. A method of adjusting a characteristic of an electron source having a plurality of electron emitting devices, the method comprising:

a characteristic changing step of changing electron emission characteristics of the electron emitting devices, wherein in the characteristic changing step, target values indication of targets for changes in electron emission characteristics are determined by reflecting a spatial distribution of electron emission characteristics of the electron emitting devices taken before the characteristic changing step on a spatial distribution of the target values whereby the total amount of the electron emission characteristic changes is less than the total amount of electron emission characteristic changes by which electron emission characteristics of all of the electron emitting devices become identical, and the electron emission characteristics are changed so as to approach the respective target values.

40. A method of adjusting a characteristic of an image display apparatus having a plurality of display devices, the method comprising:

a characteristic changing step of changing display characteristics of the display devices, wherein in the characteristic changing step, target values indication of targets for changes in diplay characteristics are determined by reflecting a spatial distribution of display characteristics of the display devices taken before the characteristic changing step on a spatial distribution of the target values whereby the total amount of the display characteristic changes is less than the total amount of display characteristic changes by which display characteristics of all of the display devices become identical, and the display characteristics are changed so as to approach the respective target values.

* * * * *

UNITED STATES PATENT AND TRADEMARK OFFICE

CERTIFICATE OF CORRECTION

PATENT NO. : 6,760,001 B2
APPLICATION NO. : 10/067796
DATED : July 6, 2004
INVENTOR(S) : Makoto Kanda et al.

It is certified that error appears in the above-identified patent and that said Letters Patent is hereby corrected as shown below:

SHEET 3

FIG. 4, “CALCURATION” should read --CALCULATION--.

SHEET 14

FIG. 18, “CALCURATION” should read --CALCULATION--.

COLUMN 5

Line 29, “high” should read --high---;
Line 35, “depend” should read --depends on--;
Line 50, “vales” should read --values--;
Line 52, “the” should be deleted--.

COLUMN 6

Line 7, “remains as it is.” should read --remain as is.--.

COLUMN 9

Line 3, “characteristics” should read --characteristic--.

COLUMN 10

Line 1, “A” should read --a--; and
Line 30, “having” should read --having an--.

COLUMN 11

Line 14, “multi electron” should read --multi-electron--.

COLUMN 13

Line 16, “an” should be deleted;
Line 22, “air-tight” should read --air-tight container--;
Line 40, “in an a” should read --in a--;
Line 42, “at” should be deleted; and
Line 57, “filed” should read --field--.

UNITED STATES PATENT AND TRADEMARK OFFICE

CERTIFICATE OF CORRECTION

PATENT NO. : 6,760,001 B2
APPLICATION NO. : 10/067796
DATED : July 6, 2004
INVENTOR(S) : Makoto Kanda et al.

It is certified that error appears in the above-identified patent and that said Letters Patent is hereby corrected as shown below:

COLUMN 14

Line 66, “achieve” should read --achieving--.

COLUMN 15

Line 17, “wring” should read --wiring--.

COLUMN 16

Line 3, “become” should read --becomes--.

COLUMN 18

Line 5, “as well” should read --as well as--; and
Line 48, “make” should read --making--.

COLUMN 20

Line 9, “a” should be deleted;
Line 12, “shift” should read --shifting--;
Line 40, “is” should read --are--;
Line 47, “disposed.)” should read --disposed--; and
Line 51, “drops),” should read --drop,--.

COLUMN 21

Line 50, “embodiment,” should read --embodiments,--; and
Line 62, “changed” should read --changed as--.

COLUMN 22

Line 48, “tart” should read --start--; and
Line 55, “device” should read --devices--.

COLUMN 23

Line 10, “wring” should read --wiring--;
Line 20, “LPx” should read --Lpx--; and
Line 41, “tx” should read --Tx--.

UNITED STATES PATENT AND TRADEMARK OFFICE

CERTIFICATE OF CORRECTION

PATENT NO. : 6,760,001 B2
APPLICATION NO. : 10/067796
DATED : July 6, 2004
INVENTOR(S) : Makoto Kanda et al.

It is certified that error appears in the above-identified patent and that said Letters Patent is hereby corrected as shown below:

COLUMN 24

Line 50, “each” should read --in each--.

COLUMN 26

Line 46, “(matrix” should read --matrix--;
Line 58, “panel.)” should read --panel)--; and
Line 61, “are,” should read --is,--.

COLUMN 27

Line 37, “measurement” should read --measurement’s--.

COLUMN 29

Line 18, “corn” should read --cone--;
Line 19, “corn” should read --cone--;
Line 26, “suitable” should read --suitably--; and
Line 46, “measurement” should read --measurement’s--.

COLUMN 30

Line 26, “an” should read --a--;
Line 53, “an” should read --a--; and
Line 60, “claims 1 to 5,” should read --claims 1, 3, or 5,--.

COLUMN 31

Line 7, “claims 1 to 5,” should read --claims 1, 3 or 5,--;
Line 18, “claims 1 to 5,” should read --claims 1, 3 or 5,--;
Line 22, “claims 1 to 5,” should read --claims 1, 3 or 5,--;
Line 26, “claims 1 to 5,” should read --claims 1, 3 or 5,--;
Line 33, “claims 1 to 5,” should read --claims 1, 3 or 5,--;
Line 57, “claims 1 to 5,” should read --claims 1, 3 or 5,--;
Line 62, “claims 1 to 5,” should read --claims 1, 3 or 5,--; and
Line 67, “claims 1 to 5,” should read --claims 1, 3 or 5,--.

UNITED STATES PATENT AND TRADEMARK OFFICE

CERTIFICATE OF CORRECTION

PATENT NO. : 6,760,001 B2
APPLICATION NO. : 10/067796
DATED : July 6, 2004
INVENTOR(S) : Makoto Kanda et al.

It is certified that error appears in the above-identified patent and that said Letters Patent is hereby corrected as shown below:

COLUMN 32

Line 4, "claims 1 to 5" should read --claims 1, 3, or 5,--;
Line 11, "claims 1 to 5," should read --claims 1, 3, or 5.--;
Line 17, "wherein" should read --wherein in--;
Line 43, "wherein" should read --wherein in--;
Line 46, "an" should read --a--; and
Line 66, "wherein" should read --wherein in--.

COLUMN 33

Line 2, "an" should read --a--;
Line 8, "claims 20 to 24," should read --claims 20, 22, or 24,--;
Line 22, "claims 20 to 24," should read --claims 20, 22, or 24,--;
Line 33,"claims 20 to 24," should read --claims 20, 22, or 24,--;
Line 37, "22," should read --24,--;
Line 42,"claims 20 to 24," should read --claims 20, 22, or 24,--; and
Line 48,"claims 20 to 24," should read --claims 20, 22, or 24,--.

COLUMN 34

Line 6, "claims 20 to 24," should read --claims 20, 22, or 24,--;
Line 11,"claims 20 to 24," should read --claims 20, 22, or 24,--;
Line 16, "claims 20 to 24," should read --claims 20, 22, or 24,--;
Line 20, "claims 20 to 24," should read --claims 20, 22, or 24,--; and
Line 27, "claims 20 to 24." should read --claims 20, 22, or 24.--.

Signed and Sealed this

Twenty-fourth Day of October, 2006

JON W. DUDAS
*Director of the United States Patent and Trademark Office*